US010883313B2

(12) United States Patent
Steele et al.

(10) Patent No.: US 10,883,313 B2
(45) Date of Patent: Jan. 5, 2021

(54) APPARATUS AND METHOD FOR DRILLING DEVIATED WELLBORES

(71) Applicant: HALLIBURTON ENERGY SERVICES, INC., Houston, TX (US)

(72) Inventors: David Joe Steele, Arlington, TX (US); Clifford Lynn Talley, Midland, TX (US); Doug Durst, Jersey Village, TX (US); Mark C. Glaser, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 277 days.

(21) Appl. No.: 15/772,007

(22) PCT Filed: Oct. 19, 2016

(86) PCT No.: PCT/US2016/057757
§ 371 (c)(1),
(2) Date: Apr. 27, 2018

(87) PCT Pub. No.: WO2017/083072
PCT Pub. Date: May 18, 2017

(65) Prior Publication Data

US 2018/0313156 A1 Nov. 1, 2018

Related U.S. Application Data

(60) Provisional application No. 62/253,560, filed on Nov. 10, 2015.

(51) Int. Cl.
*E21B 23/01* (2006.01)
*E21B 29/00* (2006.01)
(Continued)

(52) U.S. Cl.
CPC ..... *E21B 7/061* (2013.01); *E21B 23/01* (2013.01); *E21B 29/00* (2013.01); *E21B 29/06* (2013.01); *E21B 33/12* (2013.01); *E21B 43/26* (2013.01)

(58) Field of Classification Search
CPC ..... E21B 23/01; E21B 29/00; E21B 29/06; E21B 33/12; E21B 43/26; E21B 7/061
See application file for complete search history.

(56) References Cited

U.S. PATENT DOCUMENTS 2,791,278 A 5/1957 Clark, Jr.
4,807,704 A * 2/1989 Hsu ..... E21B 23/03 166/313

(Continued)

FOREIGN PATENT DOCUMENTS

EP 1212727 B1 10/2006

OTHER PUBLICATIONS

Korean Intellectual Property Office, International Search Report and Written Opinion, PCT/US20116/057757, dated Jan. 6, 2017, 16 pages, Korea.

(Continued)

*Primary Examiner* — Daniel P Stephenson

(57) ABSTRACT

Systems and methods are described for drilling a new secondary wellbore from a primary wellbore in which a production string is already deployed. The production string is severed below a desired kick-off location for the new secondary wellbore and the upstream portion of the production string is withdrawn from the primary wellbore, thereby exposing an end of the remaining production string. A lateral orientation device (LOD) is mounted on the exposed end of the production string. The LOD includes a shoulder for seating on the exposed end, anchoring mechanism(s) to secure the LOD to adjacent tubular(s), and seals to sealingly engage adjacent tubulars. The LOD may include a contoured (Continued)

surface for orientation of a tool, such as a whipstock, which may be utilized to drill a new wellbore. Alternatively, a work string may be coupled with the LOD to perform pumping operations in the wellbore below the LOD.

20 Claims, 11 Drawing Sheets

(51) Int. Cl.

| | |
|---|---|
| ***E21B 33/12*** | (2006.01) |
| ***E21B 29/06*** | (2006.01) |
| ***E21B 7/06*** | (2006.01) |
| *E21B 43/26* | (2006.01) |

(56) References Cited

U.S. PATENT DOCUMENTS

| | | | | |
|---|---|---|---|---|
| 5,311,936 | A * | 5/1994 | McNair | E21B 7/061 166/117.6 |
| 5,467,819 | A * | 11/1995 | Braddick | E21B 7/061 166/117.6 |
| 5,533,573 | A * | 7/1996 | Jordan, Jr. | E21B 7/061 166/313 |
| 5,564,503 | A * | 10/1996 | Longbottom | E21B 7/061 166/313 |
| 6,003,601 | A * | 12/1999 | Longbottom | E21B 7/061 166/313 |
| 6,019,173 | A | 2/2000 | Saurer et al. | |
| 6,244,340 | B1 | 6/2001 | McGlothen et al. | |
| 6,591,905 | B2 | 7/2003 | Coon | |
| 6,907,930 | B2 * | 6/2005 | Cavender | E21B 41/0042 166/313 |
| 7,159,661 | B2 * | 1/2007 | Restarick | E21B 41/0042 166/313 |
| 7,886,831 | B2 * | 2/2011 | Butterfield, Jr. | E21B 43/105 166/177.4 |
| 8,025,105 | B2 * | 9/2011 | Templeton | E21B 7/061 166/117.5 |
| 8,082,999 | B2 * | 12/2011 | Renshaw | E21B 43/10 166/381 |
| 8,220,547 | B2 * | 7/2012 | Craig | E21B 43/26 166/308.1 |
| 8,286,708 | B2 | 10/2012 | Assal et al. | |
| 8,316,937 | B2 | 11/2012 | Cronley et al. | |
| 8,459,345 | B2 | 6/2013 | Bell | |
| 8,813,840 | B2 | 8/2014 | Zupanick | |
| 9,951,573 | B2 * | 4/2018 | Dahl | E21B 7/061 |
| 10,450,801 | B2 * | 10/2019 | Zhang | E21B 23/002 |
| 10,502,028 | B2 * | 12/2019 | Durst | E21B 33/12 |
| 2003/0037930 | A1 | 2/2003 | Coon | |
| 2007/0034409 | A1 * | 2/2007 | Dale | E21B 7/061 175/61 |
| 2008/0029304 | A1 | 2/2008 | LeBlanc et al. | |
| 2010/0012322 | A1 | 1/2010 | McGarian | |
| 2010/0294512 | A1 * | 11/2010 | Assal | E21B 7/061 166/384 |
| 2011/0186291 | A1 | 8/2011 | Lang et al. | |
| 2012/0241144 | A1 | 9/2012 | Bell | |
| 2018/0313156 | A1 * | 11/2018 | Steele | E21B 7/061 |

OTHER PUBLICATIONS

Bjarne Neumann, Through-tubing rotary drilling intervention system coaxes more oil from aged reservoirs, Apr. 30, 2010, Retrieved Apr. 24, 2018, 4 pages, Drilling Contractor, http://www.drillingcontractor.org/through-tubing-rotary-drilling-intervention-system-coaxes-more-oil-from-aged-reservoirs-5327.

Baker Hughes—Baker Oil Tools, Sidetracking and Re-entry, 2003, Retrieved Apr. 24, 2018, p. 61, Total of 78 Pages, Enhancing Productivity, Coiled Tubing Solutions, Solve Downhole Problems With Reliable, Cost-Effective Technology, http://www.oilproduction.net/files/coiled_tubing_handbook.pdf.

Sanjay Jugdaw, Alan Mclauchlan, John C. Leith, Rajat Dave, Six Zone Intelligent Completion Installation Benefits and Lessons Learned Before Production in Offshore Indonesia, Oct. 22-24, 2013, 4 pages, SPE 165899, Society of Petroleum Engineers, SPE Asia Pacific Oil & Gas Conference and Exhibition, Jakarta, Indonesia.

Barree & Asociates, Stimulation of Horizontal Wells & Unconventional Reservoirs, Retrieved Apr. 27, 2018, 2 pages, Courses & Training, Gohfer 2D. https://barree.net/courses-training/stimulation-of-horizontal-wells-unconventional-reservoirs.html.

Schlumberger, Tech Report, Modular Whipstock Sidetracking System Saves Middle East Operator USD 1.5 Million, 2018, 1 page, Middle East, https://www.slb.com/~/media/Files/fishingsidetracking/tech_reports/trackmaster-select-mea.tr.pdf.

Schlumberger, Case Study: First 30-in Casing Exit Enables Slot Recovery in Gulf of Suez for Dana Petroleum, Retrieved Apr. 27, 2018, 1 pages, Case Studies, https://www.slb.com/~/media/Files/fishingsidetracking/case_studies/trackmaster_ch_gulf_suez_cs.pdf.

Andrew Finlay, James Bain, Alan Fairweather and James Ford, Innovative Whipstock Technology/Procedures Successfully Complete Challenging Low-Side, Uncemented Casing Exits: UK North Sea, Jun. 20-21, 2012, SPE 149625, Society of Petroleum Engineers, Galveston, Texas.

Halliburton, Activate® Refracturing Service, Retrieved Apr. 27, 2018, 2 pages, http://www.halliburton.com/en-US/ps/solutions/unconventional-resources/ACTIVATE-refracturing-service.page.

Schlumberger, TrackMaster TT Through-Tubing Whipstock System, Retrieved Apr. 27, 2018, https://www.slb.com/services/well_intervention/sidetracking-services/thru_tubing_sidetracking.aspx.

Schlumberger, Sidetracking Services, Retrieved Apr. 27, 2018, https://www.slb.com/services/well_intervention/sidetracking-services.aspx.

Wireline Solutions Downhole Completion Tools, T-2 On/Off Tools, Retrieved Apr. 27, 2018, http://www.f-e-t.com/images/uploads/On_-_Off_Tools.pdf.

* cited by examiner

APPARATUS AND METHOD FOR DRILLING DEVIATED WELLBORES

CROSS-REFERENCE TO RELATED APPLICATIONS

This application is a U.S. National Stage patent application of International Patent Application No. PCT/US2016/057757, filed on Oct. 19, 2016, which claims the benefit of U.S. Provisional Application Ser. No. 62/253,560 filed on Nov. 10, 2015, the benefit of both of which are claimed and the disclosure of both of which are incorporated herein by reference in their entireties.

BACKGROUND

In the production of hydrocarbons, it is common to drill one or more secondary wellbores (alternately referred to as lateral or branch wellbores) from a primary wellbore (alternately referred to as parent or main wellbores). The primary and secondary wellbores, collectively referred to as a multilateral wellbore may be drilled, and one or more of the primary and secondary wellbores may be cased and perforated using a drilling rig.

Thereafter, once a multilateral wellbore is drilled and completed, production equipment such as production casing is installed in the wellbore, the drilling rig is removed and the primary and secondary wellbores are allowed to produce hydrocarbons.

During any stage of the life of a wellbore, techniques may be used to stimulate the wellbore after production has begun. For example, a portion of a wellbore may be re-perforated to enhance hydrocarbon flow. Likewise, various treatment fluids may be used to stimulate the wellbore. As used herein, the terms treatment or treating refer to any subterranean operation that uses a fluid in conjunction with a desired function and/or for a desired purpose. The terms do not imply any particular action by the fluid or any particular component thereof.

One common production stimulation operation that employs a treatment fluid is hydraulic fracturing (occasionally referred to simply as "fracking"). Hydraulic fracturing operations generally involve pumping a treatment fluid (e.g., a fracturing fluid) into a well, which penetrates a subterranean formation at a sufficient hydraulic pressure to create a network of cracks (commonly referred to as fissures) in the subterranean formation through which hydrocarbons flow more freely. This increases production by increasing flow from the formation into the wellbore. In some cases, hydraulic fracturing can be repeated in a previously fractured wellbore to further enhance flow, which is a process commonly referred to as re-fracking. Re-fracturing may include extending or enlarging one or more natural or previously created fractures in the subterranean formation.

During the initial production life of a well, typically referred to as the primary phase, production of hydrocarbons generally occurs either under natural pressure, or by means of pumps that are deployed within the wellbore. This may include wellbores that have undergone production stimulation operations, such a hydraulic fracturing, during the drilling and completion process.

Over the life of a well, the natural driving pressure will decrease to a point where the natural pressure is insufficient to drive the hydrocarbons to the surface at a technically and/or economically viable rate, at which point the reservoir pressure can sometimes be enhanced by external means to increase flow. In secondary recovery, for example, treatment fluids are injected into the reservoir to supplement the natural pressure. Such treatment fluids may include water, natural gas, air, carbon dioxide or other gas.

Likewise, in addition to enhancing the natural pressure of the reservoir, it is also common through tertiary recovery, to increase the mobility of the hydrocarbons themselves in order to enhance extraction, again through the use of treatment fluids. Such methods may include steam injection, surfactant injection and carbon dioxide flooding.

In both secondary and tertiary recovery, hydraulic fracturing may also be used to enhance production of a well, as may re-perforating.

Depending on the nature of the secondary or tertiary operation, it may be necessary to redeploy a rig, often referred to as a "workover rig" to the wellbore to assist in these operations, which operations may require additional equipment be installed in the wellbore. For example, subjecting a producing wellbore to hydraulic fracturing pressures after it has been producing may damage certain casings, installations or equipment already in the wellbore. Thus, it may be necessary to install additional equipment to protect the various equipment and tools already in the wellbore before proceeding with such operations. Such additional equipment is typically of sufficient size and weight that requires the use of a workover rig. As the number of secondary wellbores in a multilateral wellbore increases, the difficulty in protecting the various equipment in the primary wellbore and the secondary wellbores becomes even more pronounced.

All of the forgoing efforts focus on stimulating or enhancing production from existing secondary wellbores in a multilateral well.

It would be desirable to provide a system that allows production from a wellbore to be enhanced by providing additional secondary wellbores in the multilateral well.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
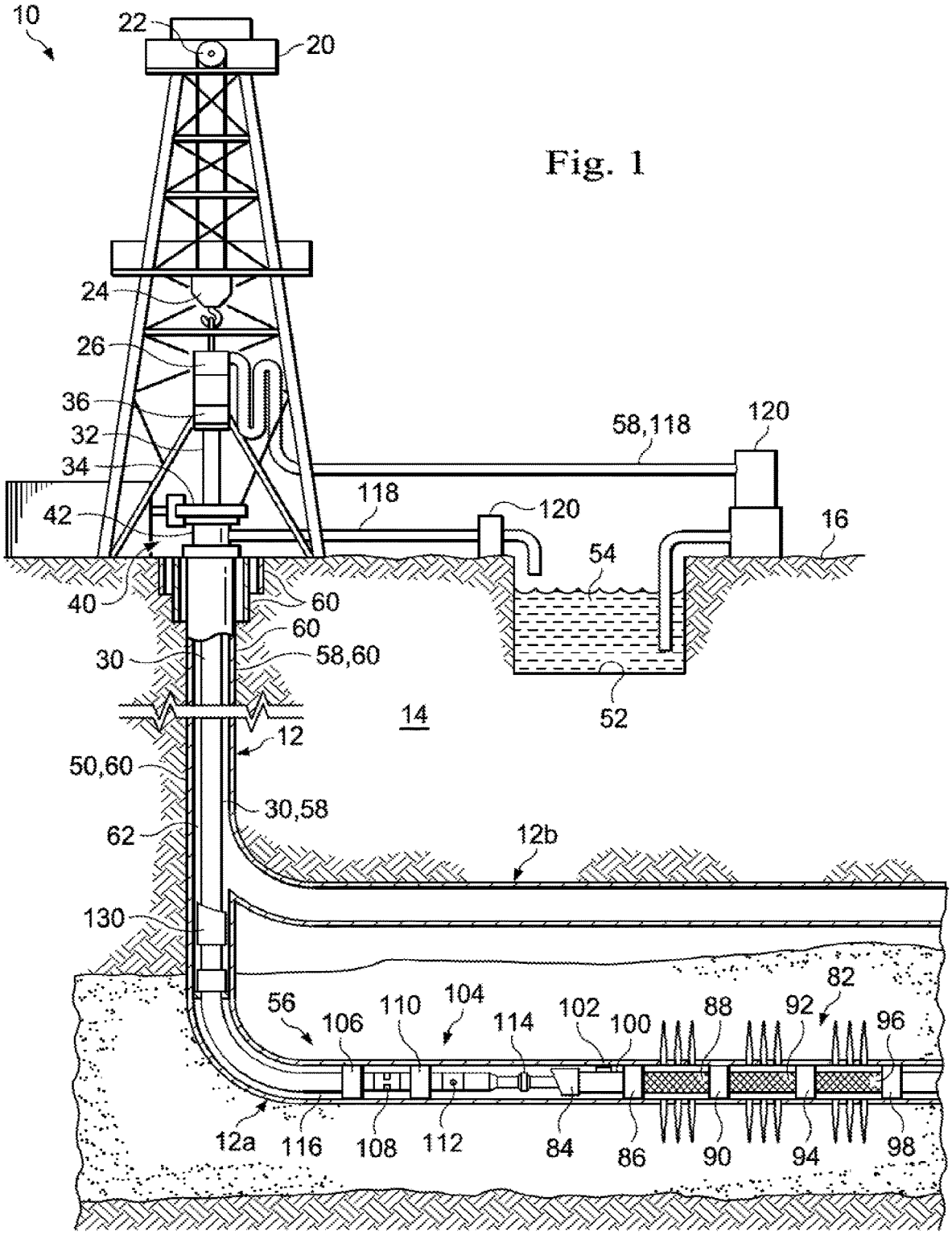
FIG. 1 is a partially cross-sectional side view of an embodiment of a lateral orientation device of the disclosure deployed in a land-based drilling and production system.

The disclosure may repeat reference numerals and/or letters in the various examples or figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a figure may depict a horizontal wellbore or a vertical wellbore, unless indicated otherwise, it should be understood by those skilled in the art that the apparatus according to the present disclosure is equally well suited for use in wellbores having other orientations including vertical wellbores, deviated wellbores, multilateral wellbores or the like. Likewise, unless otherwise noted, even though a figure may depict an offshore operation, it should be understood by those skilled in the art that the apparatus according to the present disclosure is equally well suited for use in onshore operations and vice-versa. Further, unless otherwise noted, even though a figure may depict a cased hole, it should be understood by those skilled in the art that the apparatus according to the present disclosure is equally well suited for use in open hole operations.

As used in this Detailed Description, the term primary wellbore may refer to any wellbore from which another, intersecting wellbore has been or is to be subsequently drilled; whereas the term secondary wellbore may refer to any subsequently-drilled wellbore extending from (intersecting with) that primary wellbore. Thus, in any multilateral wellbore system, the initial wellbore drilled from surface will invariably be the primary wellbore with respect to any one or more intersecting wellbores drilled therefrom, which are the secondary wellbores with respect to that initial wellbore drilled from surface. Each secondary wellbore may then itself become the "primary" wellbore with respect to any further ("secondary") wellbore(s) drilled therefrom.

Generally, in one or more embodiments, a new, secondary wellbore is drilled from a primary wellbore that already has a production string deployed therein. The production string is cut or severed at or below a desired kick-off location for the new secondary wellbore. The portion of the production string upstream or above the location of the cut is withdrawn from the primary wellbore, and a sleeve is deployed in the primary wellbore and mounted on the exposed upstream end of the production string that remains in the primary wellbore. The sleeve may be a lateral orientation device formed of a tubular body having a first end and a second end with a bore extending therebetween. A lower shoulder is formed on a surface of the tubular body and seats against the exposed end of the production string. Between the lower shoulder and the first end of the tubular body, an upper shoulder may be formed on a surface of the tubular body for landing of a tool, such as a whipstock. The tubular body may be elongated as necessary to account for the distance between the location of the cut and a location adjacent the desired kick-off. The first end of the tubular body may include a contoured surface for orientation of a tool, such as the whipstock deployed to engage the lateral orientation device. A first anchoring mechanism, such as slips or a packer, may be provided to secure the lateral orientation device to an adjacent tubular. Seals may be provided to seal between the lateral orientation device and an adjacent tubular. A second anchoring mechanism, such as slips or a packer, may likewise be deployed along the outer surface of the tubular body to stabilize the lateral orientation device within the adjacent tubular surrounding the tubular body. An engagement mechanism may be provided to secure a tool, such as the whipstock, seated on the lateral orientation device once the tool has been radially oriented by the contoured surface. Once seated on and oriented by the lateral orientation device, the tool may be utilized to perform an operation, such as a work-over operation, in a wellbore. In one or more embodiments, the tool may be a whipstock, and the whipstock may be utilized to guide a cutting mechanism for milling a window in adjacent casing (if any) and/or drilling the new secondary wellbore in the adjacent formation from a primary wellbore. Alternatively, once the lateral orientation device is deployed, a work string may be deployed and coupled with the lateral orientation device in order to perform pumping services, such as hydraulic fracturing, in a primary or secondary wellbore below the lateral orientation device.

Figure 2:
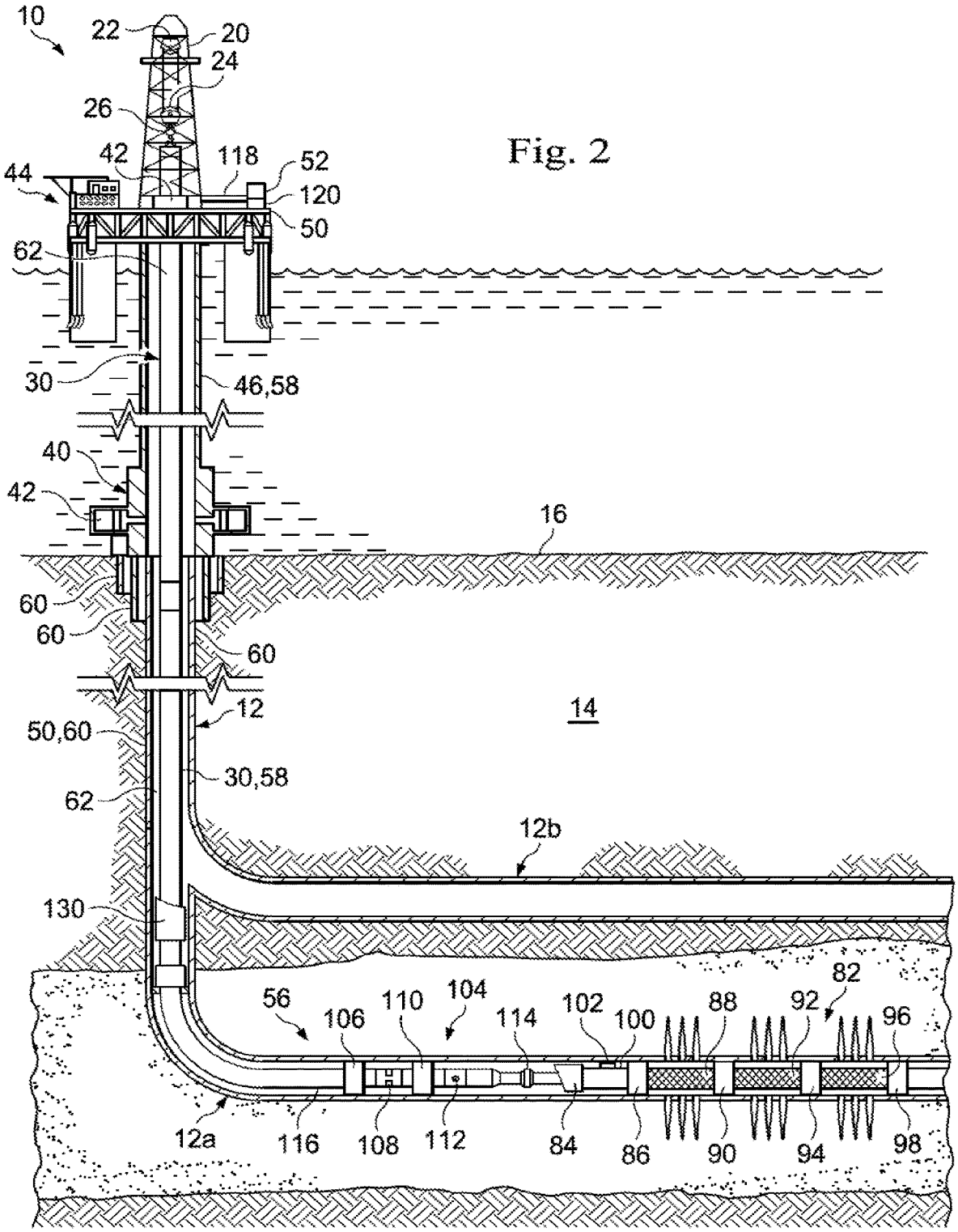
FIG. 2 is a partially cross-sectional side view of an embodiment of the lateral orientation device of the disclosure deployed in a marine-based production system.

Turning to FIGS. 1 and 2, shown is an elevation view in partial cross-section is a lateral orientation device 130 deployed in a wellbore drilling and production system 10 (land based in FIG. 1 and offshore in FIG. 2) utilized to produce hydrocarbons from wellbore 12 extending through various earth strata in an oil and gas formation 14 located below the earth's surface 16. Wellbore 12 may be a primary wellbore and may include one or more secondary wellbores 12*a*, 12*b* . . . 12*n*, extending into the formation 14, and disposed in any orientation and spacing, such as the horizontal secondary wellbores 12*a*. 12*b* illustrated.

Drilling and production system 10 may include a drilling rig or derrick 20. Drilling rig 20 may include a hoisting apparatus 22, a travel block 24, and a swivel 26 for raising and lowering a conveyance vehicle such as tubing string 30. Other types of conveyance vehicles may include tubulars such as casing, liner, drill pipe, work string, coiled tubing, production tubing (including production liner and production casing), and/or other types of pipe or tubing strings collectively referred to herein as tubing string 30. Still other types of conveyance vehicles may include wirelines, slicklines or cables. In FIGS. 1 and 2, tubing string 30 is a substantially tubular, axially extending work string or production string, formed of a plurality of pipe joints coupled together end-to-end supporting a completion assembly as described below. Drilling rig 20 may include a kelly 32, a rotary table 34, and other equipment associated with rotation and/or translation of tubing string 30 within a wellbore 12. For some applications, drilling rig 20 may also include a top drive unit 36.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the wellbore drilling and production system 10.

For offshore operations, as shown in FIG. 2, whether drilling or production, drilling rig 20 may be mounted on an oil or gas platform, such as the offshore platform 44 as illustrated, or on semi-submersibles, drill ships, and the like (not shown). Wellbore drilling and production system 10 of FIG. 2 is illustrated as being a marine-based production system. Likewise, wellbore drilling and production system 10 of FIG. 1 is illustrated as being a land-based production system. In any event, for marine-based systems, one or more subsea conduits or risers 46 extend from deck 50 of platform 44 to a subsea wellhead 40.

Tubing string 30 extends down from drilling rig 20, through riser 46 and BOP 42 into wellbore 12.

A fluid source 52, such as a storage tank or vessel, may supply a working or service fluid 54 pumped to the upper end of tubing string 30 and flow through tubing string 30. Fluid source 52 may supply any fluid utilized in wellbore operations, including without limitation, drilling fluid, cementious slurry, acidizing fluid, liquid water, steam, hydraulic fracturing fluid, propane, nitrogen, carbon dioxide or some other type of fluid.

Wellbore 12 may include subsurface equipment 56 disposed therein, such as, for example, the completion equipment illustrated in FIG. 1 or 2. In other embodiments, the subsurface equipment 56 may include a drill bit and bottom hole assembly (BHA), a work string with tools carried on the work string, a completion string and completion equipment or some other type of wellbore tool or equipment.

Wellbore drilling and production system 10 may generally be characterized as having a pipe system 58. For purposes of this disclosure, pipe system 58 may include casing, risers, tubing, drill strings, completion or production strings, subs, heads or any other pipes, tubes or equipment that attaches to the foregoing, such as tubing string 30 and riser 46, as well as the primary and secondary wellbores in which the pipes, casing and strings may be deployed. In this regard, pipe system 58 may include one or more casing strings 60 that may be cemented in wellbore 12, such as the surface, intermediate and production casing strings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

As shown in FIGS. 1 and 2, subsurface equipment 56 is illustrated as completion equipment and tubing string 30 in fluid communication with the completion equipment 56 is illustrated as production tubing 30. Completion equipment 56 is disposed in secondary wellbore 12*a* and includes a lower completion assembly 82 having various tools such as an orientation and alignment subassembly 84, a packer 86, a sand control screen assembly 88, a packer 90, a sand control screen assembly 92, a packer 94, a sand control screen assembly 96 and a packer 98.

Extending uphole and downhole from lower completion assembly 82 is one or more communication cables 100, such as a sensor or electric cable, that passes through packers 86, 90 and 94 and is operably associated with one or more electrical devices 102 associated with lower completion assembly 82, such as sensors positioned adjacent sand control screen assemblies 88, 92, 96 or at the sand face of formation 14, or downhole controllers or actuators used to operate downhole tools or fluid flow control devices. Cable 100 may operate as communication media, to transmit power, or data and the like between lower completion assembly 82 and an upper completion assembly 104.

In this regard, disposed in secondary wellbore 12*a*, the upper completion assembly 104 is coupled at the lower end of tubing string 30. The upper completion assembly 104 includes various tools such as a packer 106, an expansion joint 108, a packer 110, a fluid flow control module 112 and an anchor assembly 114.

Extending uphole from upper completion assembly 104 are one or more communication cables 116, such as a sensor cable or an electric cable, which passes through packers 106, 110 and extends to the surface 16. Cable(s) 116 may operate as communication media, to transmit power, or data and the like between a surface controller (not pictured) and the upper and lower completion assemblies 104, 82.

Fluids, cuttings and other debris returning to surface 16 from wellbore 12 may be directed by a flow line 118 back to storage tanks, fluid source 52 and/or processing systems 120, such as shakers, centrifuges and the like.

In each of FIGS. 1 and 2, a lateral orientation device 130, or more generally, a sleeve, is shown deployed in primary wellbore 12 along tubing string 30 in the vicinity of a secondary wellbore 12*b* that has been drilled utilizing the lateral orientation device 130. In these embodiments, it will be appreciated that secondary wellbore 12*b* has been drilled after subsurface equipment 56 has been installed in secondary wellbore 12*a*. Although primary wellbore 12 need not be cased for the purposes of the disclosure, in some embodiments, primary wellbore 12, as shown in the figures, may be at least partially cased at the junction with secondary wellbore 12*b*. While generally illustrated as vertical, primary wellbore 12, as well as any of the other wellbores 12*a*, 12*b* . . . 12*n* described, may have any orientation.

Figure 3:
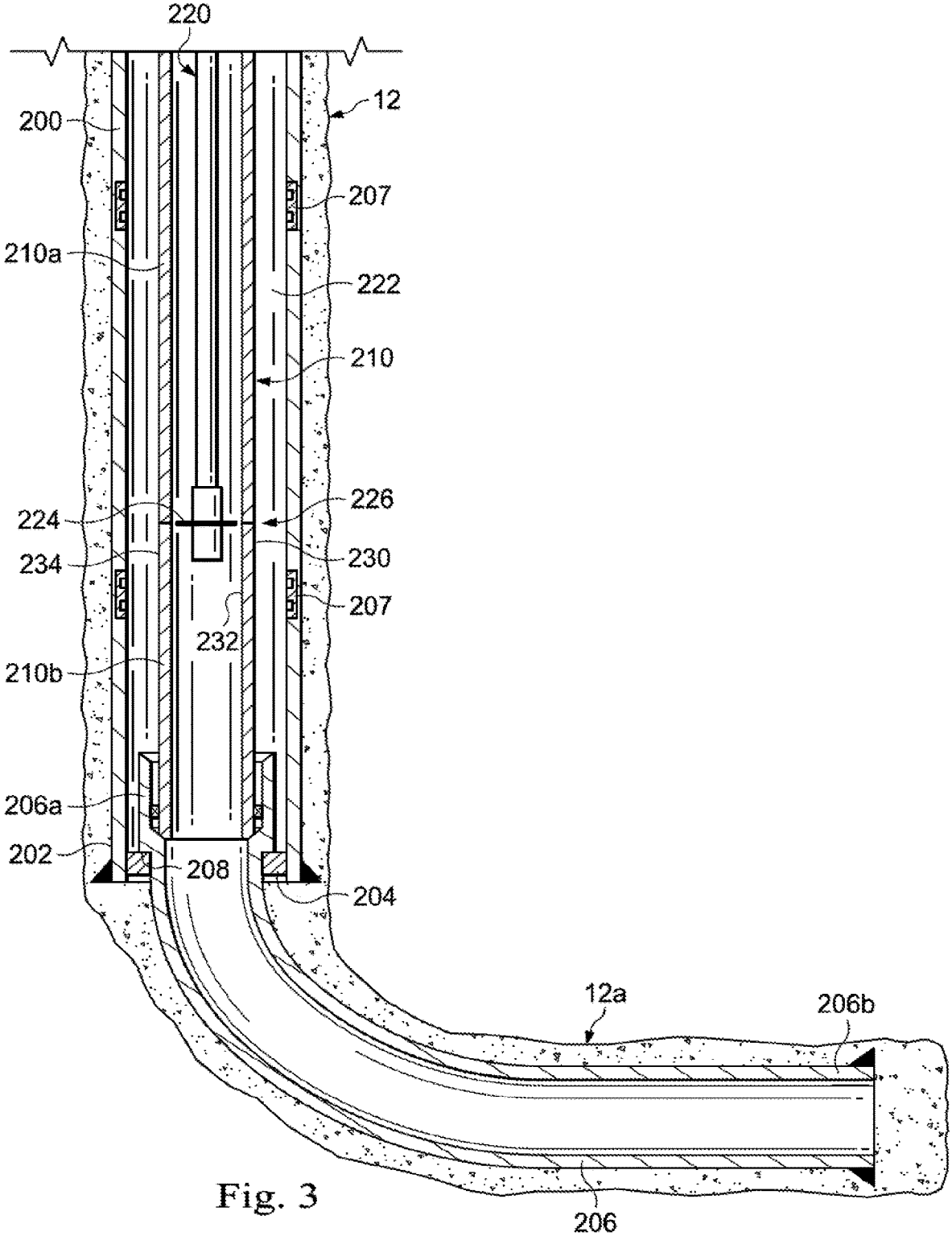
FIG. 3 is an elevation view in cross-section of a wellbore system of the disclosure with a cutting tool disposed at a desired kick-off point for a new secondary wellbore.

Turning to FIG. 3, a wellbore system including a portion of primary wellbore 12 and secondary wellbore 12*a* extending from primary wellbore 12 are illustrated in more detail. While lateral orientation device 130 (FIGS. 1 and 2) and the methods described herein may be utilized in either cased or uncased wells, in FIG. 3, primary wellbore 12 is illustrated as being cased, with primary wellbore casing 200 deployed and cemented in place within primary wellbore 12. At the distal end 202 of primary wellbore 12, a casing hanger 204 may be deployed from which secondary wellbore casing 206 hangs. Secondary wellbore casing 206 has a proximal end 206*a* and a distal end 206*b*. The proximal end 206*a* may include a shoulder 208 for supporting casing 206 on hanger 204. Secondary wellbore casing 206 is illustrated as cemented in place within wellbore 12*a*. Primary wellbore casing 200 may include engagement or depth mechanisms 207 spaced apart therealong. Depth mechanisms 207 may be used for placement of lateral orientation device 130, whipstock 276 (described below) or any of the other tools described herein.

A tubular string 210, or more narrowly, a production string 210 (also generally referenced above as tubing string 30), is shown in fluid communication with secondary wellbore 12*a*. Persons of ordinary skill in the art will appreciate that while the lateral orientation device 130 will be described primarily herein with reference to tubular string 210 being a "production string", the foregoing is for illustrative purposes only and is not limited to use with only production strings, but may be utilized with any tubular strings deployed within a wellbore 12, including tubing, liner, casing and pipe. Thus, additionally or alternatively, lateral orientation device 130 may be employed with any existing tubing, liner, casing or pipe in a wellbore so long as it can be severed as described herein for receipt of a sleeve, the lateral orientation device 130 or other tool, as described herein. Likewise, persons of ordinary skill in the art will appreciate that the described primary and secondary wellbores 12, 12*a*, 12*b* are for illustrative purposes only, and are not intended to be limiting. The lateral orientation device 130 as described herein, and the methods of use, may be deployed in any type of wellbore. For example, secondary wellbore casings 206 are not limited to a particular size or manner of support, and other systems for supporting secondary wellbore casing 206 may be utilized. It will further be appreciated that the disclosure is not limited to a particular configuration for secondary wellbore 12*a* or the subsurface equipment 56 installed therein. The overall well system includes a tubular, such as tubular string 210 (working string (not shown) or tubing string 30), deployed therein that can be cut and on which lateral orientation device 130 may be deployed.

Tubular string 210 can be characterized as having an upper portion 210*a* and a lower portion 210*b*. At least lower portion 210*b* is substantially fixed within the primary wellbore 12 so that tubular string 210 is not readily movable axially without taking some additional action, like releasing anchors or other mechanisms securing lower portion 210*b* within the primary wellbore 12. Upper portion 210*a* may also be fixed to the extent an additional action may be taken (such as releasing slips or anchors, in order to allow manipulation as described below).

In any event, also illustrated in FIG. 3 is a cutting tool 220. Cutting tool 220 may be any type of tool that can be deployed within primary wellbore 12 to sever tubular string 210 below a desired kick-off point for a new secondary wellbore. Cutting tool 220 may be deployed inside tubular string 210 or within the annulus 222 between tubular string 210 and primary wellbore casing 200. Without limiting cutting tool 220 to a particular type, cutting tool 220 may employ a saw blade 224, a pressurized fluid stream, a laser or other light energy, electromagnetic pulse (EMP) or other means to sever tubular string 210. Once tubular string 210 has been severed at a desired new secondary wellbore kick-off location, such as location 226, cutting tool 220 is withdrawn from the primary wellbore 12. Likewise, upper portion 210*a* of tubular string 210 that is upstream, uphole or otherwise above location 226 is withdrawn, while lower portion 210*b* of tubular string 210 that is downstream, downhole or otherwise below location 226 is left in the primary wellbore 12. It will be appreciated that location 226 may be selected to be above or upstream of any fixation point for lower portion 210*b* within primary wellbore 12. Of course, to the extent upper portion 210*a* is also fixed in some way, additional action may be necessary (such as disengaging an anchoring mechanism) in order to release upper portion 210*a* from primary wellbore 12 before withdrawal. Once cut, lower portion 210*b* will have a proximal end or an upper end 230, and can generally be characterized as having an inner surface 232 and an outer surface 234.

Figure 4:
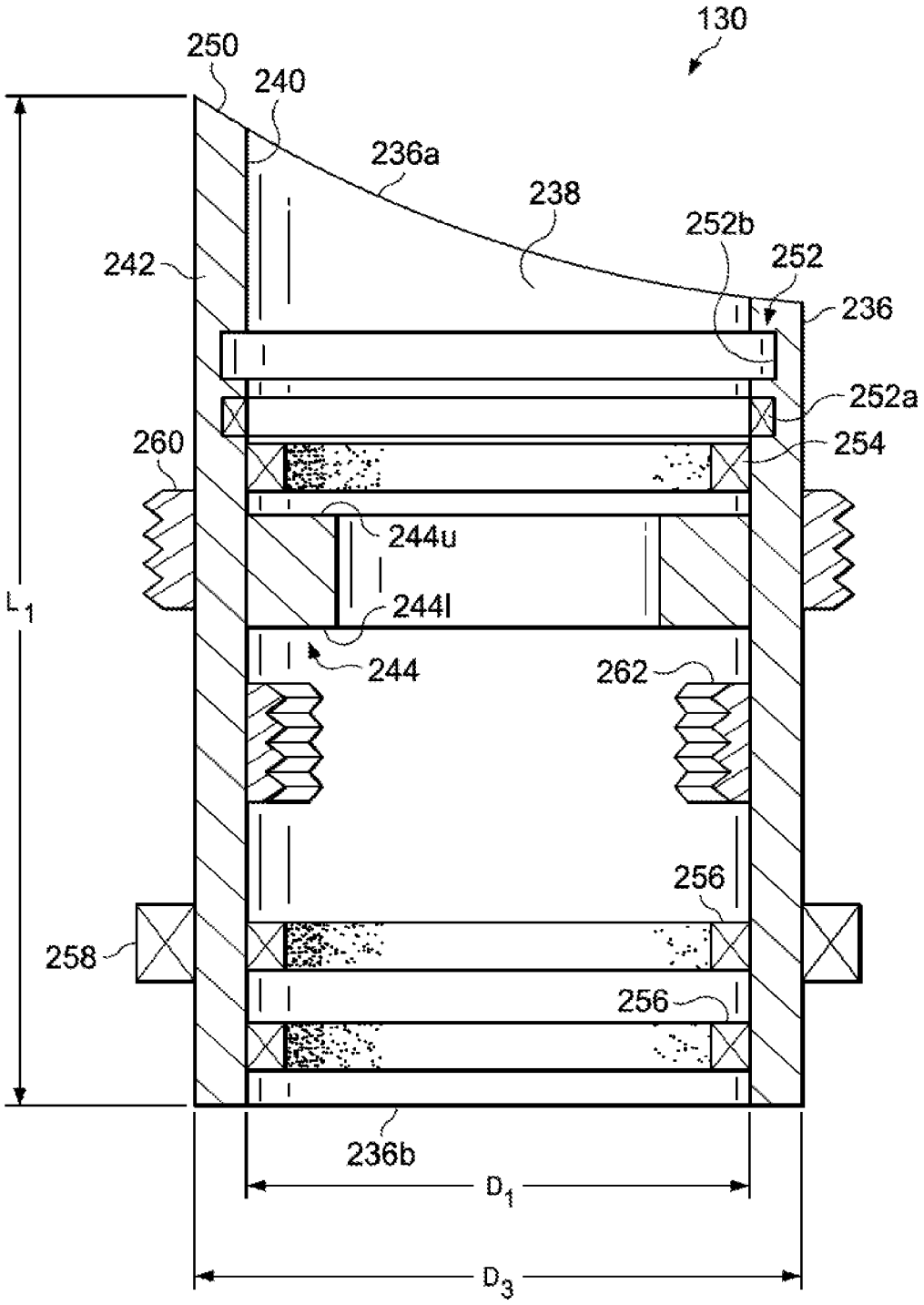
FIG. 4 is a cross-sectional side view of the lateral orientation device of the disclosure.

With reference to FIG. 4, lateral orientation device 130 is shown in more detail. Lateral orientation device 130 is formed of a tubular body 236 having a first end 236*a* and a second end 236*b* with a bore 238 extending therebetween. Tubular body 236 may have a length $L_1$ selected based on the spacing between the location 226 where a tubular string 210 (FIG. 3) is severed and the location where an operation within the primary wellbore 12 is to be performed. Thus, in some cases, $L_1$ may be range from 0.5 feet to 10 feet, while in other cases, tubular body 236 $L_1$ may be tens or hundreds of feet in length. Likewise, tubular body 236 may include a single length of tubular or pipe or may be multiple or a plurality of lengths joined together. Tubular body 236 is characterized by an inner surface 240 and an outer surface 242. One or more shoulders 244*u*, 244*l* (generally or collectively shoulders 244) are provided along one of the inner and outer surfaces 240, 242 of tubular body 236. In some embodiments, multiple spaced apart shoulders 244, such as an upper shoulder 244*u* and a lower shoulder 244*l*, may be provided. In some embodiments, one shoulder, e.g., upper shoulder 244*u* may be formed on one of the inner and outer surfaces 240, 242 of the tubular body 236, while the other shoulder, e.g., lower shoulder 244*l* is formed on the other of the inner and outer surfaces 240, 242 of tubular body 236 such that the shoulders 244*u*, shoulder 244*l* are on opposite surfaces 240, 242. Additionally, where tubular body 236 is comprised of multiple lengths of tubular or pipe, the upper shoulder 244*u* may be on a first length comprising the tubular body 236 and the lower shoulder 244*l* may be on a second length comprising the tubular body 236. Moreover, one or more spacer lengths of pipe or tubing may comprise the tubular body 236 to separate the first and second lengths in order to achieve the desired length Lt. In some embodiments, particularly where $L_1$ is greater than 5 feet, the upper shoulder 244*u*, may be positioned more approximate the first end 236*a* of tubular body 236 and the lower shoulder 244*l* may be positioned more approximate the second end 236*b* of tubular body 236. In one or more embodiments, such as the illustrated embodiment, both shoulders 244*a*, 244*l* are provided along the inner surface 240, while in other embodiments, shoulders 244*u*, 244*l* may be provided along outer surface 242. Persons of ordinary skill in the art will appreciate that the position of shoulders 244 simply dictates whether lateral orientation device 130 will mount over the end 230 of tubular string lower portion 210*b* and engage the outer surface 234 of tubular string lower portion 210*b* (in the case of shoulders 244 disposed along inner surface 240) or whether lateral orientation device 130 will mount within the end 230 of tubular string lower portion 210*b* and engage the inner surface 232 of tubular string lower portion 210*b* (in the case of shoulders 244 disposed along outer surface 242). Likewise, shoulders 244 are not limited to a particular shape, but may be defined on any lug, projection or other device that can engage the end 230 of tubular string 210 (FIG. 3) or more generally, the exposed end of any severed tubing string 30 (FIGS. 1 and 2). In some embodiments, shoulders 244 may be defined on a projection that can be biased so as to engage a notch or other void formed in lower portion 210*b*.

An orientation mechanism 250 may be disposed or otherwise formed at the first end 236*a* of tubular body 236. Although orientation mechanism 250 may be any mechanism or device that permits radial orientation of a tool or equipment engaging tubular body 236, in one or more embodiments, orientation mechanism 250 may be a scoop head, a muleshoe or a ramped or angled surface or edge (such as the illustrated ramped edge).

Lateral orientation device 130 may further include one or more engagement mechanisms 252*a*, 252*b* (generally or collectively engagement mechanisms 252) disposed along a surface, such as inner surface 240. In one or more embodiments, the engagement mechanisms 252 are disposed between upper shoulder 244, and the first end 236*a* of tubular body 236. Engagement mechanisms 252 may be any engagement or coupling device that that allows a tool or other device to be secured to lateral orientation device 130. In one or more embodiments, engagement mechanisms 252 may include a latch coupling 252*a* for engagement with a latch (not shown). In one or more embodiments, engagement mechanisms 252 may include a notch 252*b* formed in inner surface 240. Latch coupling 252*a* and notch 252*b* are for illustrative purposes only and could be other mechanisms or devices that are well known in the art.

Lateral orientation device 130 may further include one or more seals disposed along one or both surfaces 240, 242. In the illustrated embodiment, a first inner seal 254 is disposed along inner surface 240 between shoulders 244 and the first end 236*a* of tubular body 236. First inner seal 254 may be between the engagement mechanisms 252 and the shoulder 244. A second inner seal 256 is disposed along inner surface 240 between shoulders 244 and the second end 236*b* of tubular body 236. An outer seal 258 is disposed along outer surface 242 between the first and second ends 236*a*, 236*b*. The seals are not limited to any particular type of seal as long as they seal the space between adjacent components. In one or more embodiments, seals 254 and 256 are each one or more elastomeric elements. In one or more embodiments, seal 258 may include elastomeric elements.

Lateral orientation device 130 may further include anchoring mechanisms disposed along one or both surfaces 240, 242 to secure the lateral orientation device to an adjacent tubular surface and/or wellbore wall. Thus, an anchoring mechanism 260 is illustrated. In one or more embodiments where anchoring mechanism 260 is slips, the slips may be disposed along outer surface 242. Anchoring mechanism 260 may be deployed between the outer seal 258 and the first end 236*a* of tubular body 236. An anchoring mechanism 262 may also be provided along inner surface 240 adjacent second end 236*b* of tubular body 236.

Anchoring mechanism 262 may be slips. Anchoring mechanism 262 may be provided between shoulders 244 and second inner seal 256. In some embodiments (not shown) the positioning of the anchoring mechanism 262 and the seals 256 may be reversed, e.g., the anchoring mechanism 262 may be below the seals 262. If the anchoring system 262 is below the seals 256, the anchoring system 262 may not need to withstand the pressures contained by the seals 256. In one or more embodiments, anchoring mechanism 262 may include elastomeric elements. In one or more embodiments, anchoring mechanism 260 may include elastomeric elements, in which case, in some embodiments, anchoring mechanism 260 and outer seal 258 may be the same component, functioning to both seal the annulus 222 (FIG. 3) and anchor the lateral orientation device 130 to primary wellbore casing 200 as described below. In other cases, a packer functioning primarily as an anchoring mechanism 260 may be separate from the outer seal 258.

Figure 5:
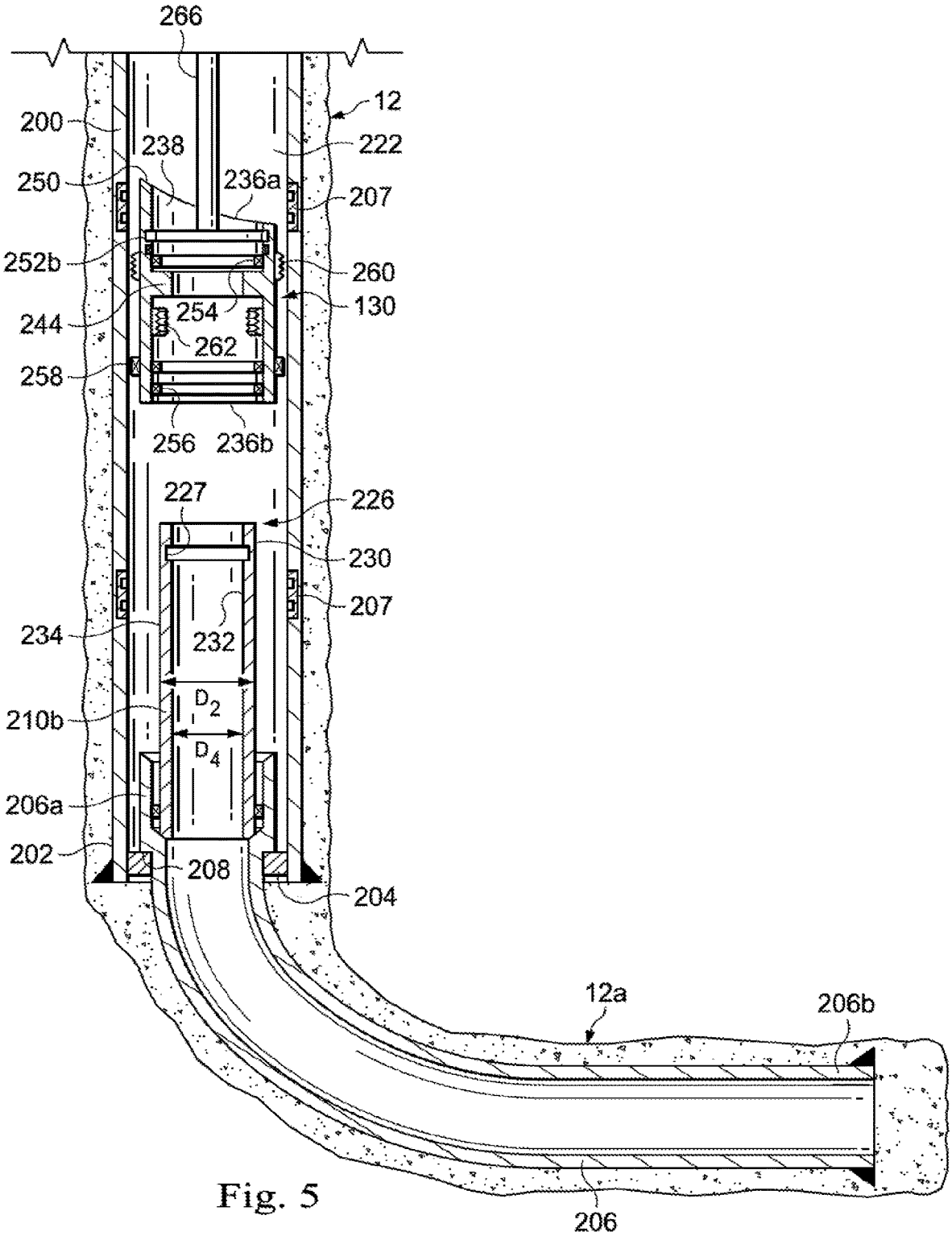
FIG. 5 is a cross-sectional elevation view of the wellbore system of FIG. 3 illustrating the lateral orientation device of FIG. 4 carried by a run-in tool.

Turning to FIG. 5 and with on-going reference to FIG. 4, lateral orientation device 130 is shown during deployment in primary wellbore 12. Although not limited to a particular vehicle for deployment, a run-in tool 266 is shown. Run-in tool 266 may attach to lateral orientation device 130, such as for example, utilizing notch 252*b* or another engagement mechanism 252. In any event, lateral orientation device 130 is lowered until it engages the upper end 230 of the tubular lower portion 210*b*. In this regard, lateral orientation device 130 may have an internal diameter $D_1$ (FIG. 4) that is larger than the external diameter $D_2$ of the tubular lower portion 210*b* allowing lateral orientation device 130 to fit over the upper end 230 of tubular lower portion 210*b*. Alternatively, lateral orientation device 130 may have an external diameter $D_3$ that is smaller than the internal diameter $D_4$ of the tubular lower portion 210*b*, allowing lateral orientation device 130 to fit within tubular lower portion 210*b*. As explained above, in the case of the former, shoulders 244 will be along the inner surface 240 of tubular body 236 while in the case of the latter, shoulder 244 will be along the outer surface 242 of tubular body 236. In any case, run-in tool 266 lowers lateral orientation device 130 until the end 230 of tubular 210*b* abuts lower shoulder 244*l*. Run-in tool 266 may be manipulated to radially orient lateral orientation device 130 until a desired angular position for lateral orientation device 130 is achieved.

Figure 6:
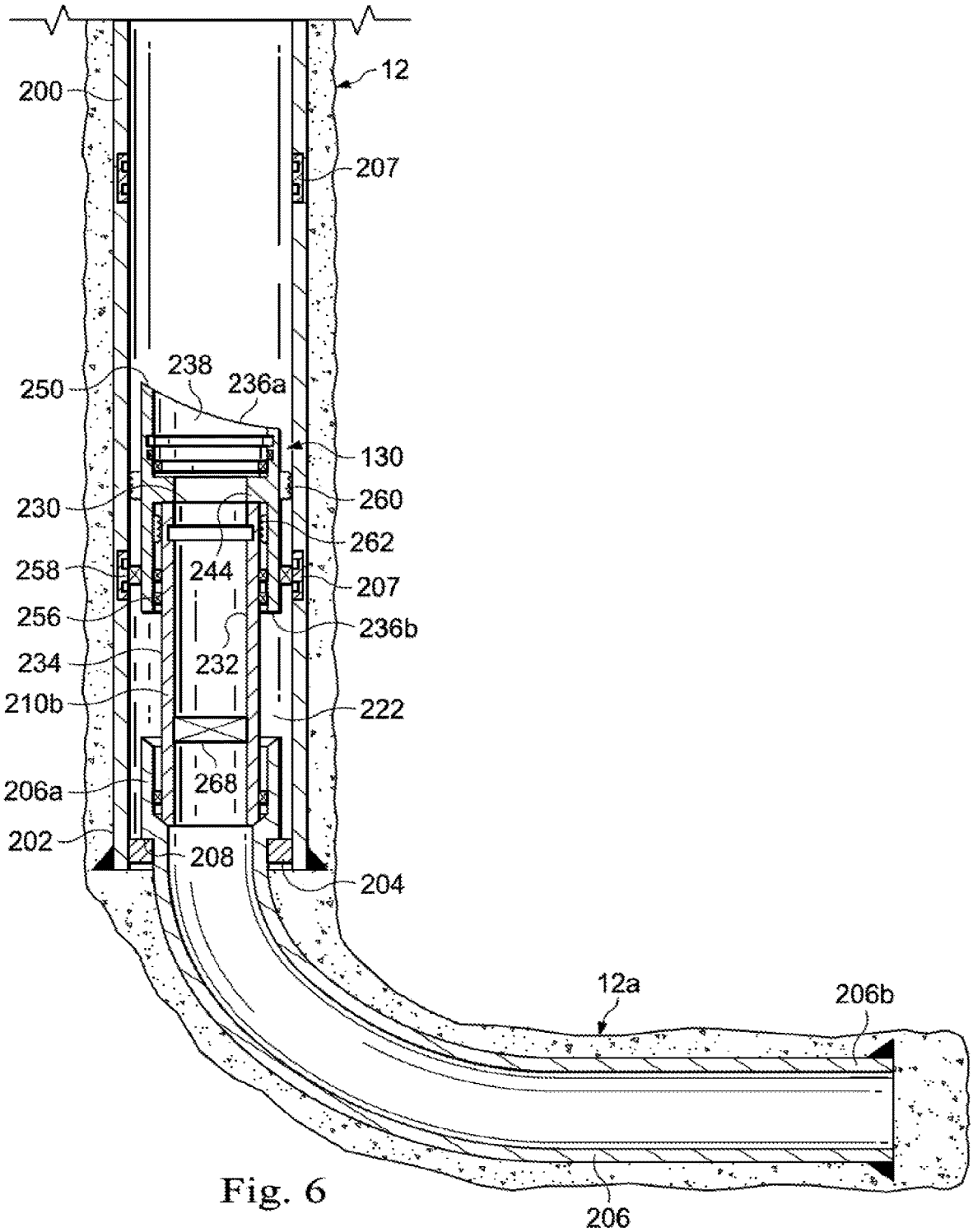
FIG. 6 is a cross-sectional elevation view of the wellbore system of FIG. 3 illustrating the lateral orientation device positioned adjacent the desired kick-off point for the new secondary wellbore.

As illustrated in FIG. 6, once lateral orientation device 130 has been positioned so that lower shoulder 244*l* is seated on the end 230 of tubular lower portion 210*b*, and the desired radial position has been achieved, the various seals 256, 258 and anchoring mechanism 260 may be manipulated. In the illustrated embodiments, slips or other anchoring mechanisms 260 are manipulated or otherwise deployed to engage primary wellbore casing 200 (or the wellbore wall in the instance of an uncased primary wellbore 12), anchoring tubular body 236 of lateral orientation device 130 to the primary wellbore casing 200.

Likewise, slips or other anchoring mechanism 262 may be manipulated or otherwise deployed to engage the outer surface 234 of tubular lower portion 210*b*, anchoring tubular body 236 to tubular lower portion 210*b*. When the foregoing slips or anchoring mechanisms 260, 262 are set, lateral orientation device 130 is thus anchored in position at a location adjacent the desired kick-off point for the new secondary wellbore. In particular, lateral orientation device 130 is locked in place both axially and radially. In addition, lateral orientation device 130 functions to support and/or axially centralize the otherwise free end 230 of the lower portion 210*b* of tubular string 210 (FIG. 3).

Similarly, with lateral orientation device 130 in position, a packer or other outer seal 258 may be deployed to seal annulus 222 between lateral orientation device 130 and primary wellbore casing 200. Seals 256 seal the annulus 222 between tubular lower portion 210*b* and lateral orientation device 130.

In one or more embodiments, before removal from the primary wellbore 12, run-in tool 266 (FIG. 5) may be utilized to actuate one or more of anchoring mechanisms 260, 262, seals 256, 258 or any other packers, seals, slips or other anchoring mechanisms, as desired. Similarly, in embodiments, run-in tool 266 may be utilized to set a plug 268 at a location below lateral orientation device 130, such as within the tubular lower portion 210*b* as illustrated, or in another component such as secondary wellbore casing 206, or a lateral wellbore liner as desired.

Figure 7:
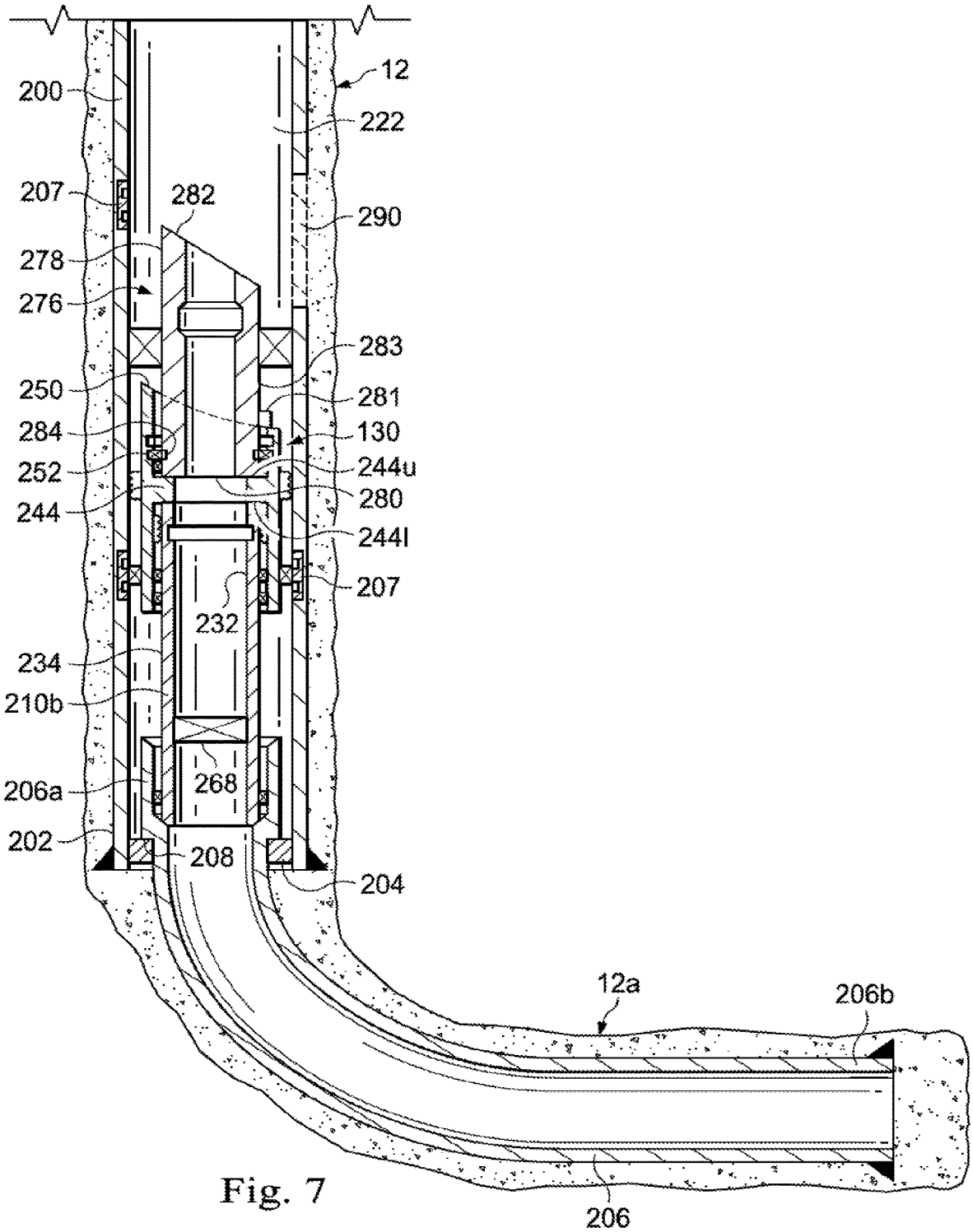
FIG. 7 is a cross-sectional elevation view of the wellbore system of FIG. 6 illustrating the lateral orientation device positioned adjacent the desired kick-off point with a whipstock seated thereon.

As illustrated in FIG. 7, the lateral orientation device 130 is installed, and a tool 276, such as a whipstock, is deployed to engage lateral orientation device 130. While tool 276 is described as a whipstock, tool 276 may be any tool utilized to perform an operation in primary wellbore 12 after severing a tubular string 210 (FIG. 3) as more generally described herein. Whipstock or tool 276 may be of any shape or configuration, but generally has first end 278 and a second end 280. A guide or contoured surface 282 is provided at first end 278. Tool 276 may include a follower 281, such as a lug or similar device protruding from an outer surface 283 thereof. In some embodiments where upper shoulder 244*u* is provided along the inner surface 240 (FIG. 3) of tubular body 236, follower 281 is preferably positioned along the outer surface 283 of tool 276 and may protrude from the outer surface 283 to engage orientation mechanism 250 of lateral orientation device 130 in order to rotate tool 276 to the desired angular position within primary wellbore 12. In other embodiments (not shown) where upper shoulder 244*a* is provided along the outer surface 242 (FIG. 4) of tubular body 236, follower 281 is preferably positioned along the inner surface of tool 276 and may protrude from an inner surface of the tool 276 to engage orientation mechanism 250. Likewise, tool 276 may include a depth mechanism 284 disposed to engage an engagement mechanism 252 disposed along one of the surfaces, such as inner surface 240 (FIG. 4), to secure the oriented tool 276 to tubular body 236 of lateral orientation device 130. More specifically, when tool 276 is deployed within lateral orientation device 130, tool 276 is axially positioned so that the first end 278 of tool 276 is adjacent the location of a desired window 290 in primary wellbore casing 200 and radially positioned so that the contoured surface 282 will direct, deflect or otherwise guide tools in the direction of the desired window 290. In one or more embodiments, the second end 280 of tool 276 may seat on upper shoulder 244*u*.

It should be appreciated that as described herein, when tool 276 is a whipstock, the whipstock is not limited to any particular type of whipstock, but may be any device which will deflect, direct or otherwise guide a tool or device in the direction of desired opening 290. In some embodiments, tool 276 may be a solid body, while in other embodiments, tool 276 may include an interior passage extending therethrough. Similarly, more than one tool 276 may be deployed for different purposes. Thus, for example a first whipstock may be deployed in the lateral orientation device 130 for milling and/or drilling, while a different whipstock may be deployed in the lateral orientation device 130 for other operations, such as installation of a liner in new secondary wellbore 12*b* (FIG. 8) or the positioning of a straddle stimulation tool (not shown) extending between primary wellbore 12 and secondary wellbore 12*b*.

It should further be appreciated that the upper and lower shoulders 244*a*, 244*l* are provided as a seat or no-go mechanism for engaging another tubular. Thus, both shoulders 244*u*, 244*l* may be provided on the same surface 240, 242 (FIG. 4) of the lateral orientation device 130 or the shoulders 244*u*. 244*l* may be provided on opposite surfaces 240, 242. In some embodiments, the upper shoulder 244*u*, and lower shoulder 244*l* are defined by the same protrusion, while in other embodiments, the shoulders 244*u*, 244*l* are defined on separate protrusions. In cases where lateral orientation device 130 fits over the exposed end 230 of tubular lower portion 210*b* (FIG. 5), then the lower shoulder 244*l* is positioned along the inner surface 240 of tubular body 236, while the upper shoulder 244*u* could be positioned on either the inner surface 240 or outer surface 242 for seating of tool 276. In cases where lateral orientation device 130 fits within the exposed end of tubing 210*b*, then the lower shoulder 244*l* is positioned along the outer surface 242 of tubular body 236, while the upper shoulder 244*u* could be positioned on either the inner surface 240 or outer surface 242 for seating of tool 276.

Figure 8:
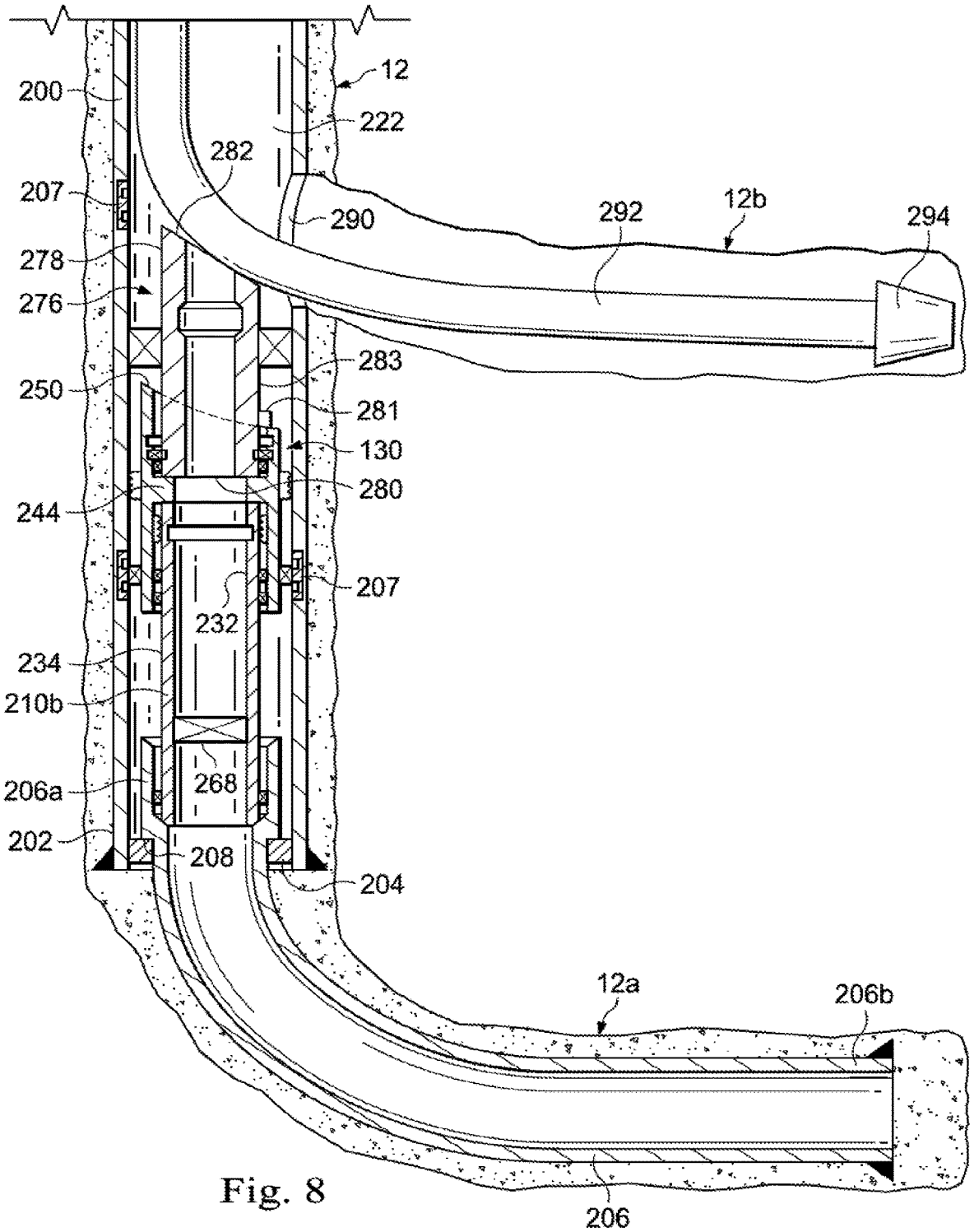
FIG. 8 is a cross-sectional elevation view of the wellbore system of FIG. 7 with a cutting tool engaging the whipstock and creating a lateral wellbore.

Turning to FIG. 8, after tool 276 has been landed on lateral orientation device 130, an operation in primary wellbore 12 may be performed, such as for example, a workover operation. In some embodiments, the operation may be the drilling of secondary wellbore 12*b*. Thus, where tool 276 is a whipstock, after the whipstock has been landed on lateral orientation device 130, a cutting tool 292 may be deployed to mill a window 290 into primary wellbore casing 200 (to the extent primary wellbore 12 is cased) and to otherwise drill new secondary wellbore 12*b*, as shown. The disclosure is not limited to a particular type of cutting tool and includes any cutting tool known in the industry. In one or more embodiments, cutting tool 292 may include a mill to form window 290. In one or more embodiments cutting tool 292 may include a drill bit 294 to drill into formation 14.

Figure 9:
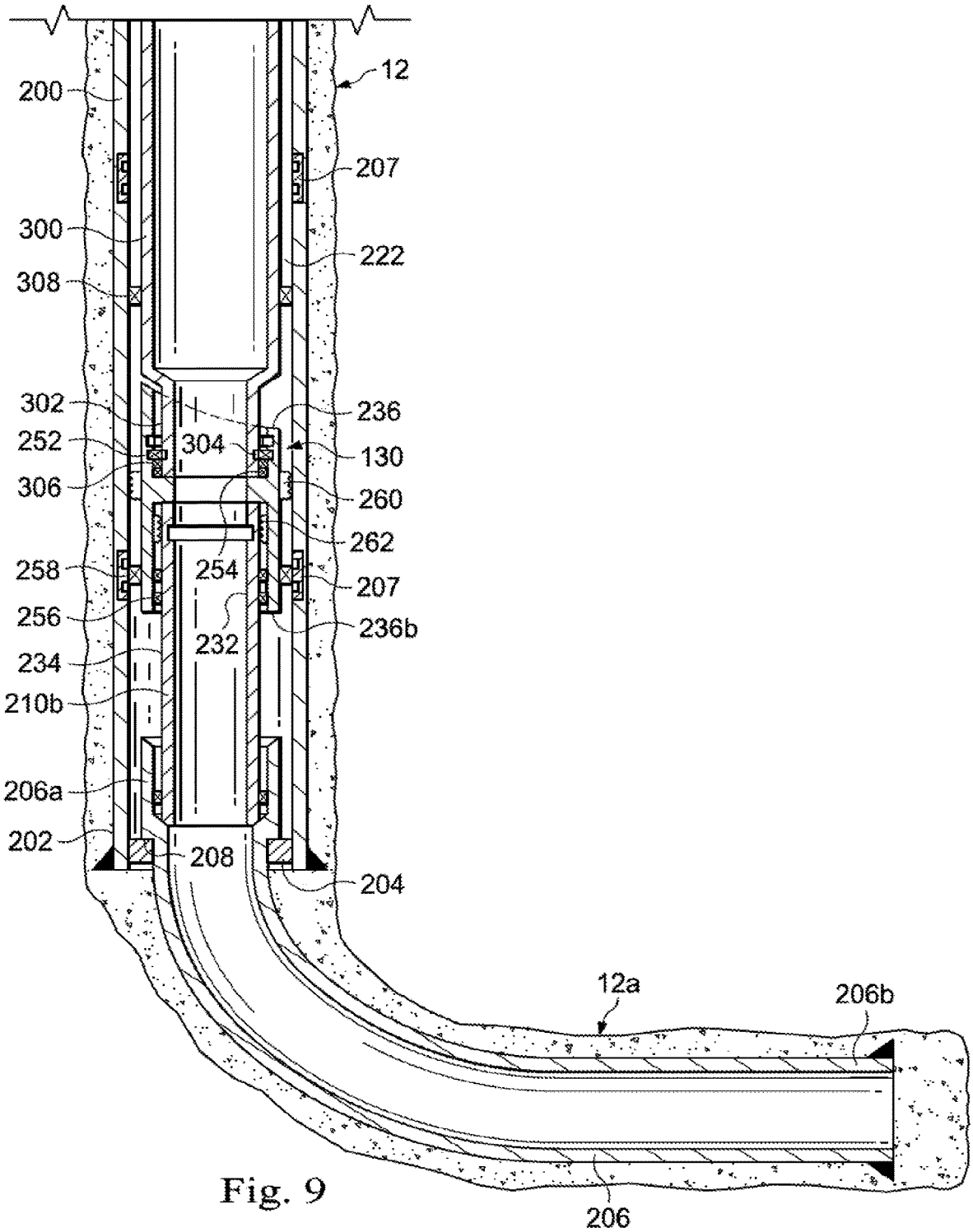
FIG. 9 is a cross-sectional elevation view of the wellbore system of FIG. 6 illustrating a work string engaging the lateral orientation device in order to perform pumping operations below the lateral orientation device.

Turning to FIG. 9, either prior to or after drilling a new secondary wellbore 12*b* (FIG. 8), it may be desirable to perform one or more pumping operations in existing secondary wellbore 12*a* or primary wellbore 12 below the lateral orientation device 130. Such pumping operations may include fracture/re-fracture and flow back in primary wellbore 12 and/or secondary wellbore 12*a*. In such case, a work string 300 may be deployed within the primary wellbore 12 to engage lateral orientation device 130 or a tubular below lateral orientation device 130. As shown, work string 300 may include a distal end 302 on which may be mounted an engagement mechanism 304 and/or one or more seals 306. In the illustrated embodiment, engagement mechanism 304 of work string 300 couples to engagement mechanism 252 of lateral orientation device 130. Seal 306 seals the annular space between work string 300 and the interior surface 240 of tubular body 236. The seal 254 of lateral orientation device 130 may likewise seal between the work string 300 and lateral orientation device 130. A packer 308 may also be deployed on work string 300, and may be set once work string 300 is stabbed into or otherwise seated on lateral orientation device 130. After work string 300 has been stabbed into lateral orientation device 130, high pressure pumping operations, such as fracturing, can be performed. In this regard, a high pressure fluid may be deployed through primary wellbore 12 into secondary wellbore 12*a* without subjecting the primary wellbore casing 200 to the high pressure of the pressurized fluid. Thus, the foregoing provides a method for high pressure pumping in a lower portion of a primary wellbore 12 (which may include existing secondary wellbore 12*a*) while isolating an upper portion of primary wellbore 12 (which may include a new secondary 12*b*) from the pressures associated with the high pressure pumping operation.

Packer 308 may be particularly useful in the case of failure of one seals 254, 306, limiting exposure of the primary wellbore casing 200 to the high pressure of the pressurized fluid. Another advantage of such an arrangement is that pressure can be applied in the annulus 222 between the work string 300 and the primary wellbore casing 200 during pumping operations. If a leak in the work string 300 develops, an increase in the annulus pressure would occur, alerting an operator and allowing the operator to take appropriate action.

It will be appreciated that while a secondary wellbore 12*a* is utilized in the description, the lateral orientation device 130 as described herein may simply be utilized with production casing, production liner, production tubing, and/or a combination thereof or other tubing, or tubings, associated with production equipment in the primary wellbore 12.

Figure 10:
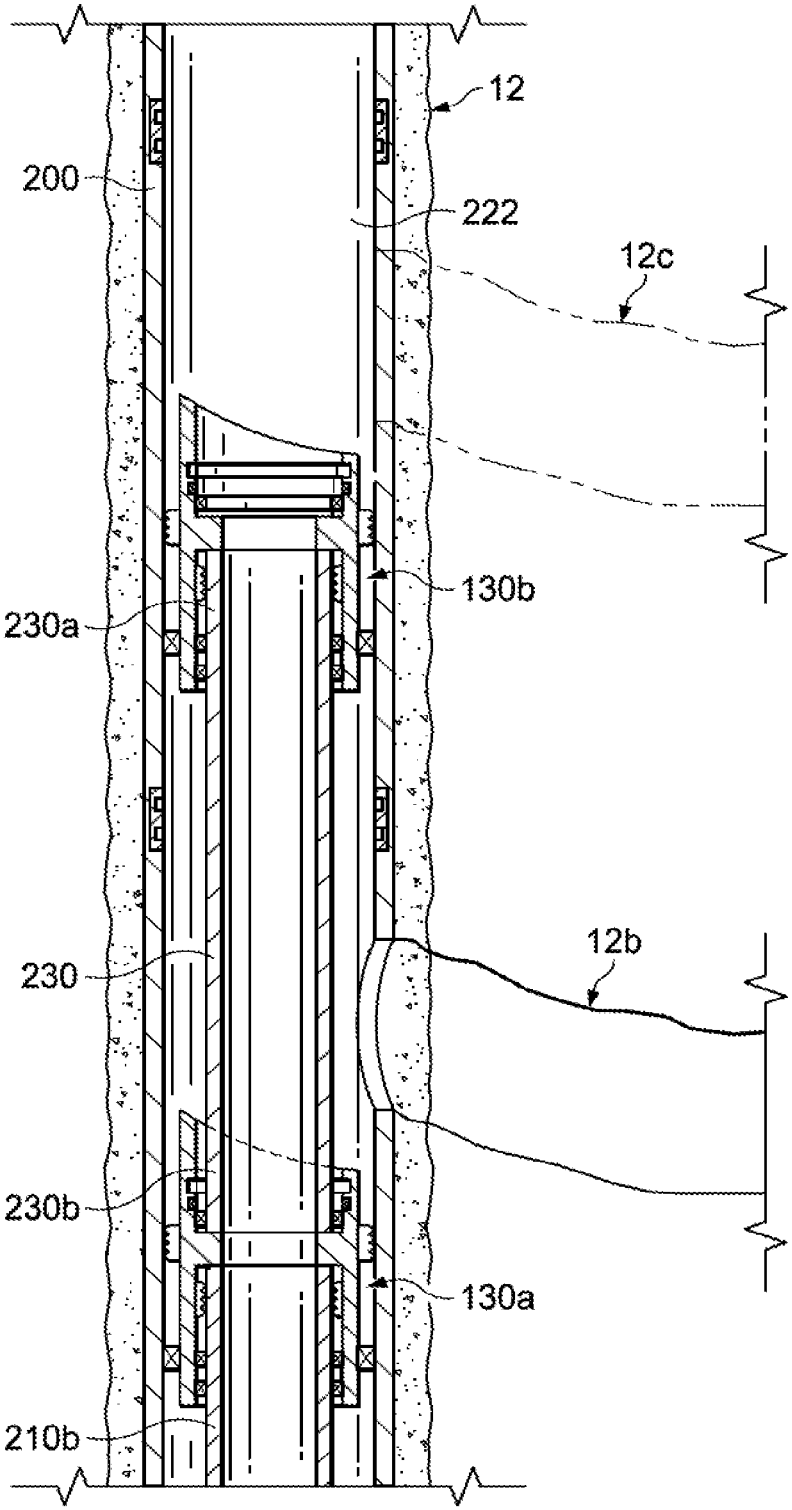
FIG. 10 is a cross-sectional elevation view of a wellbore system illustrating multiple lateral orientation devices deployed in a wellbore.

Furthermore, while only a single lateral orientation device 130 has been described heretofore, it will be appreciated that a wellbore may have multiple lateral orientation devices 130*a*, 130*b* as illustrated in FIG. 10. The multiple lateral orientation devices 130*a*, 130*b* may be spaced apart axially along the primary wellbore 12, each successively installed along the primary wellbore 12 once a secondary wellbore, e.g., secondary wellbore 12*b*, has been drilled and completed. For example, once a lower lateral orientation device 130*a* is employed to drill secondary wellbore 12*b*, an upper lateral orientation device 130*b* may be installed at a kick-off point for a new secondary wellbore 12*c* to be drilled. FIG. 10 illustrates multiple lateral orientation devices 130*a*, 130*b* separated by a tubular 230 having an upper end 230*a* seated within the upper lateral orientation device 130*b* and a lower end 230*b* seated within the lower lateral orientation device 130*a*. The length of the tubular 230 is selected based on the desired spacing between kick-off points for consecutive secondary wellbores 12*b*, 12*c*. It will be appreciated that in such case, the lower end 230*b* of tubular 230 seats on an upper shoulder 244*u* (FIG. 3) of lower lateral orientation device 130*a*, while the upper end 230*a* of tubular 230 receives upper lateral orientation device 130*b* and engages a lower shoulder 244*l* in the manner described herein.

Likewise, the lateral orientation device 130 may be deployed in a secondary wellbore to drill a new twig wellbore therefrom.

Figure 11:
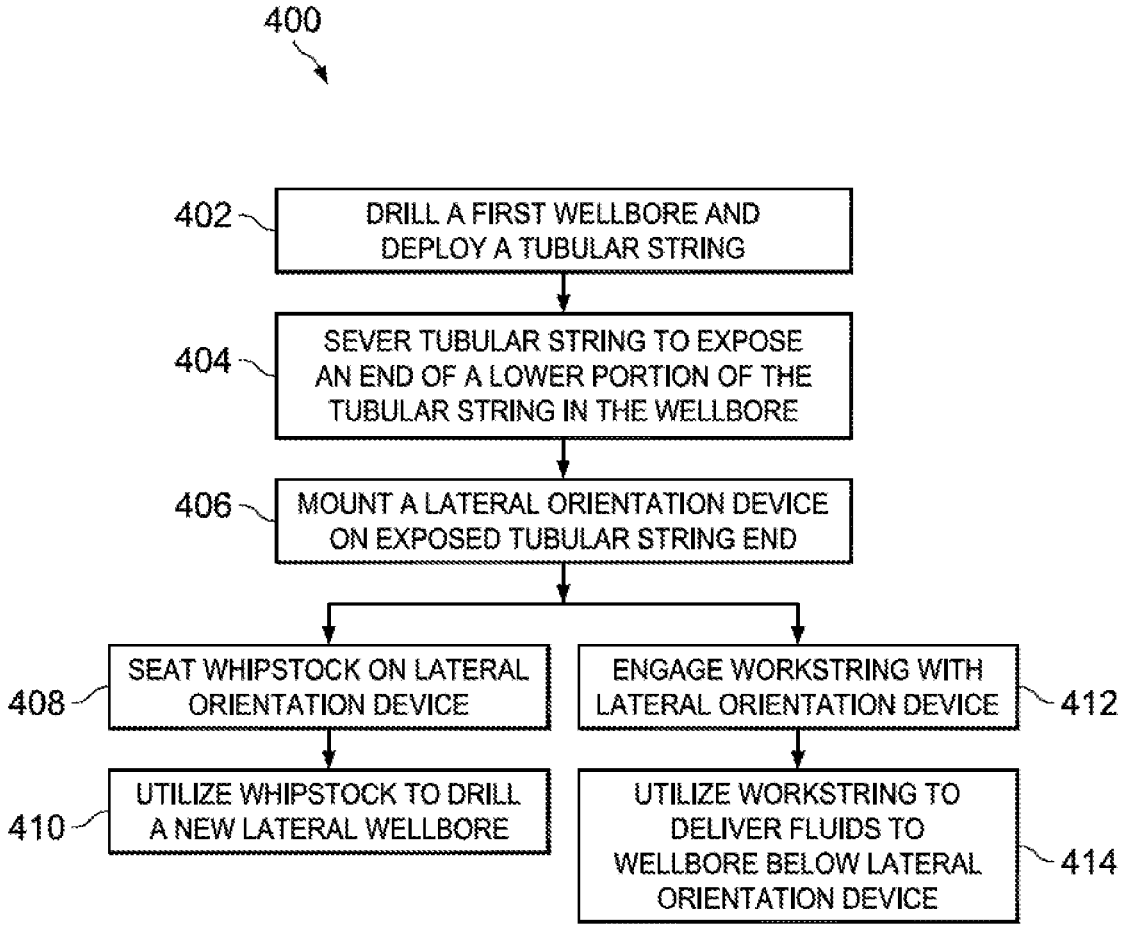
FIG. 11 is a flowchart that illustrates a method for drilling a new secondary wellbore in a wellbore system having production equipment installed therein.

Turning to FIG. 11, a method 400 of performing an operation in a wellbore having a substantially fixed tubular string deployed therein is illustrated. More particularly, the substantially fixed tubular string is any tubular string that is deployed in the wellbore and spaced apart from the wellbore walls such that an annulus exists between the tubular string and the wellbore wall (whether the wellbore wall is cased or uncased). In this regard, "substantially fixed" refers to a tubular string that has been deployed and anchored or otherwise secured within a tubing string or wellbore surrounding the substantially fixed tubing string. For example, the substantially fixed tubular string may be production tubing or some other type of pipe string that is permanently or temporarily secured from axial movement within the wellbore. In one or more embodiments, the substantially fixed tubular string may be a production string that has been utilized for a period of time during production operations following completion of a wellbore. Thus, the operation to be performed may be a workover operation after the wellbore has been producing for a period of time.

Method 400 generally involves cutting the substantially fixed tubular string disposed within the wellbore in order to expose an end of the cut tubular string. The upper portion of the substantially fixed tubular string upstream or above the location of the cut is withdrawn from the wellbore, and a sleeve is deployed in the wellbore and mounted on the exposed upper end of the tubular string remaining in the wellbore. It will be appreciated that the points of fixation of the substantially fixed tubular string may be below the location of the cut, thus enabling the upper portion of the tubular string to be withdrawn. The sleeve is thereafter used to perform an operation in the wellbore, such as drilling a new secondary wellbore or high pressure pumping to a portion of the wellbore below and/or above the sleeve. In this regard, a tool may be deployed to engage the sleeve. The sleeve may orient the tool and secure the tool in a desired orientation for use in the particular operation.

In one or more embodiments, the operation may be the drilling a secondary wellbore from a primary wellbore, such as is described above and generally illustrated in FIG. 8. In this regard, method 400 generally involves cutting of a production string, i.e., the substantially fixed tubular string, below a desired kick-off location for a new wellbore and withdrawing the production tubing above the cut in order to expose the end of the production tubing remaining in the wellbore. A sleeve, such as lateral orientation device 130 (FIG. 4) described herein, is secured to the exposed end of the production string, after which a tool, such as a whipstock, is engaged with the sleeve. For example, a lateral orientation device is secured to the exposed end of the production string, and a whipstock is engaged with the lateral orientation device so that the whipstock is positioned in a desired orientation for drilling the secondary wellbore. The whipstock can then be used to guide mills, drills and other equipment towards and into the new secondary wellbore as desired.

Thus, in step 402, a first or primary wellbore 12 is drilled and a tubular string 210 is deployed in the primary wellbore 12. The primary wellbore 12 may be cased or uncased.

The tubular string 210 is substantially fixed, anchored or otherwise secured (either temporarily or more permanently) in the primary wellbore 12 so that it cannot readily move axially without further manipulation, such as disengaging an anchor. In one or more embodiments, the tubular string 210 is substantially fixed by activating slips or a packer. Alternatively or in addition thereto, in one or more embodiments, subsurface equipment 56, such as production equipment, is deployed in the primary wellbore 12 or a secondary wellbore 12*a* extending therefrom, and the tubular string 210 is production tubing extending from the production equipment to a wellhead 40. In one or more embodiments, a deviated secondary wellbore 12*a* may be drilled from the primary wellbore 12 and secondary wellbore casing 206 or a liner string may be deployed at least partially in the deviated secondary wellbore 12*a*. In one or more embodiments, hydrocarbons are produced from or through the primary wellbore 12 for a period of time following drilling and deployment of a tubular string 210 in step 402. In one or more embodiments, the primary wellbore may be a main wellbore or it may be a lateral wellbore, depending on the secondary wellbore to be drilled. Thus, in one or more embodiments, the primary or "first" wellbore may be a lateral wellbore drilled off of a main wellbore and the "second" wellbore is a twig wellbore. In the event that the primary wellbore already exists, the task of drilling in step 402 may be omitted or modified.

In step 404, the tubular string 210 deployed in step 402 is cut until severed to expose an upper end 230 of a lower portion 210*b* of the tubular string 210. The location of the cut is selected based on the intended operations to subsequently be performed. Thus, in one or more embodiments, to the extent a new deviated secondary wellbore 12*b*, 12*c* is to be drilled, the location of the cut is selected to be below a desired kick-off point for the new deviated secondary wellbore 12*b*, 12*c*. The tubular string 210 may be severed from inside or outside the tubular string 210 by a cutting tool 220. In one or more embodiments, a cutting tool 220 (FIG. 3) is deployed through the interior of the tubular string 210 and cuts outwardly through the tubular string 210 in order to sever the tubular string 210. The cutting tool 220 may employ a mechanical, chemical or electrical cutter, which may include a saw blade 224, laser, pressurized fluid stream such as a water jet, EMF pulse or some other means to sever the tubular string 210. In some embodiments, a chemical cutter may be employed to sever the tubular string 210. Chemical cutters dissolve pipe with a clean cut that leaves no debris and does not require milling prior to pipe retrieval.

Once the tubular string 210 has been severed, the upstream or upper portion 210*a* of the tubular string 210, i.e., the tubular string 210 above the location of the cut, is withdrawn from the primary wellbore 12, thereby exposing the proximal or upper end 230 (FIG. 5) of the downstream or lower portion 210*b* of the tubular string 210, i.e., the tubular string 210 below the location of the cut that remains in the primary wellbore 12. To the extent the upper portion 210*a* of the tubular string 210 is fixed, the fixation mechanism is activated to disengage to allow the upper portion 210*a* of the tubular string 210 to be removed from the primary wellbore 12. In one or more embodiments, fixation devices may be actuated above and below the location of the cut in order to stabilize the tubular string 210 during cutting, after which, at least the fixation devices above the cut are disengaged as described above.

Although the lateral orientation device 130 may be used with any type of tubular string 210 deployed within a wellbore, in one or more embodiments, the tubular string 210 to be cut is spaced apart from a primary wellbore casing 200 or other casing string cemented into the primary wellbore 12 (or the wall of the wellbore in uncased wellbores) such that an annulus 222 exists between the tubular string 210 to be cut and the casing 200 (or wall). In this regard, in one or more embodiments, the tubular string 210 to be cut is production casing or tubing deployed in a wellbore 12. More generally, the tubular string 210 may be any casing, production string or tubing that can be manipulated, i.e., severed and withdrawn to expose an end, as described herein.

In step 406, a sleeve or other tool is mounted on the exposed upper end 230 of the lower tubular string portion 210*b*. The sleeve or tool may be mounted over the exposed end 230 or within the interior of the exposed end 230. In one or more embodiments, the sleeve or tool is a lateral orientation device 130 as described above. For purposes of the following discussion, the sleeve or tool will be described as a lateral orientation device 130, but persons of skill in the art will appreciate that the method need not be limited in certain embodiments to the specific lateral orientation device 130 described above. Likewise, while a sleeve is more generally described, the method may be used to mount any type of tool on the cut, exposed end of a tubular string. In any event, in one or more embodiments, the lateral orientation device 130 is deployed using a run-in tool 266. In one or more embodiments, the lateral orientation device 130 is seated on the end 230 of the tubular string lower portion 210*b* so that a shoulder 244*t* formed on the lateral orientation device 130 abuts the end 230 of the tubular string lower portion 210*b*. In one or more embodiments, at least a portion of the inner diameter $D_1$ (FIG. 4) of the lateral orientation device 130 is larger than the outer diameter $D_2$ (FIG. 5) of the tubular string lower portion 210*b*, so that at least a portion of the lateral orientation device 130 fits over the end 230 of the tubular string lower portion 210*b*. In one or more embodiments, a portion of the outer diameter $D_3$ (FIG. 4) of the lateral orientation device 130 is smaller than the inner diameter $D_4$ (FIG. 5) of the tubular string lower portion 210*b*, so that at least a portion of the lateral orientation device 130 fits within the end 230 of the tubular string lower portion.

In other embodiments, preferably at step 404 or 406, the upper end, e.g. upper end 230 of the lower portion 210*b* of tubular string 210 (FIG. 5), may be conditioned for engagement with a sleeve or tool, such as lateral orientation device 130, to be mounted on the end of tubular string. For example, a notch, slot, hole or other aperture or void 227 (see FIG. 5) may be cut or formed on the interior surface 232 or exterior surface 234 of end 230 to allow a device or feature like shoulders 244 to seat therein. Although only one void 227 is illustrated, it should be appreciated that in some embodiments a plurality of apertures or voids 227 may be cut on the inner surface to increase the torque rating and to distribute the stresses among the plurality of voids. This may occur prior to cutting or severing of tubular string 210 or subsequent to cutting. Likewise, the profile of the end 230 may be shaped as desired for receipt of lateral orientation device 130. In one or more embodiments, the end 230 is conditioned during cutting. For example, the end 230 may be shaped, ramped or angled or the cut may otherwise be made on a plane that is not perpendicular to the axis of the tubular string 210. This conditioning may occur as part of step 404 or separately.

In any case, as part of step 406, a shoulder on the sleeve or tool is landed on the exposed end of the lower tubing string portion. The landing of a shoulder 244 on the end 230 of tubular string 210 establishes an axial position for the sleeve, tool or lateral orientation device. The sleeve, tool or lateral orientation device may likewise be rotated to establish a desired radial position. The disclosure is not limited to a particular method for ensuring radial orientation. In one or more embodiments, the conditioned end 230 of tubular string lower portion 210*b* may be utilized to establish both an axial position and a radial position. For example, apertures 227 may be provided in a known radial and or axial orientation.

While in some embodiments, the sleeve, tool or lateral orientation device 130 is oriented based on conditioning of the end 230, in other embodiments, the orientation of the lateral orientation device 130, or more generally, a sleeve, does not have to be related to end 230. In this regard, the orientation of the lateral orientation device 130 may made from the surface by knowing the direction of the deflector face or orientation mechanism 250 of the lateral orientation device 130 and the desired orientation of the planned secondary wellbore. Typically, operators will plan secondary wellbores 12*b*, 12*c* to intersect the natural fractures of a geologic formation in a perpendicular direction. The orientation of the lateral orientation device's face, and hence the orientation of the secondary wellbore, can be set by 1) rotating the work string or run-in tool 266 that is carrying the lateral orientation device into the wellbore, 2) and actuating an engagement mechanism to anchor the lateral orientation device as described below.

More particularly, once lateral orientation device 130 is positioned as desired, various slips or other anchoring mechanisms 260 may be actuated to anchor the lateral orientation device 130 to adjacent tubulars. In one or more embodiments, a set of slips may be actuated to engage the lateral orientation device 130 to the primary wellbore casing 200, securing the lateral orientation device 130 relative to the primary wellbore 12. Additionally, in one or more embodiments, a set of slips or other anchoring mechanisms 262 may be actuated to engage the lateral orientation device 130 to the tubular string lower portion 210*b*, securing the lateral orientation device 130 relative to the tubular string lower portion. The slips may consist of individual slips that will prevent the lateral orientation device 130 from rotating relative to the upper end 230 of the lower portion 210*b* of the tubular string 210. In another embodiment, the slips may have a slight bias to their teeth so the slips hold the lateral orientation device 130 from moving up and down and a slight bias to prevent the lateral orientation device 130 from rotating with respect to the upper end 230 of the lower portion 210*b* of the tubular string 210. Other anchoring mechanisms 260, 262, such as a packer, may also be used to anchor the lateral orientation device 130. In other embodiments, the anchoring mechanisms may include an expandable liner hanger where rubber elements are expanded to anchor the lateral orientation device 130 axially and rotationally, while also providing a seal.

Finally, sealing may be established between the lateral orientation device 130 and adjacent tubulars. In one or more embodiments, a packer may be actuated to seal the annulus 222 (FIG. 6) between the lateral orientation device 130 and the primary wellbore casing 200. In one or more embodiments, an outer seal 258 may be actuated to seal between the lateral orientation device and the tubular string lower portion 210*b*.

Actuation of the packers and the seals is not limited to a particular manner of actuation.

A plug 268 (FIG. 7) may be set below the desired kick-off point in order to seal off the lower portions of the wellbore 12 from the area of the new secondary wellbore 12*b*. The plug 268 may be run-in and set on the same nm as step 404 or step 406, or the plug 268 may be run in and set at a different time.

While the lateral orientation device 130 is most preferably mounted on the exposed end of the lower portion of the tubular string so as to be in direct fluid communication with the lower portion of the tubular string 210*b*, in other embodiments, lateral orientation device 130 may be positioned in primary wellbore casing 200 above the location 226 where tubular string 210 is severed. In such case, it will be appreciated that lateral orientation device 130, or more broadly, a sleeve, can be anchored to casing string 200 utilizing anchoring mechanism 260 and sealed utilizing seals 258 as described herein. In any event, when so positioned, lateral orientation device 130, or more broadly a sleeve, may still be used to seat a tool 276, such as a whipstock, as described herein.

In step 408, a tool 276, such as a whipstock, is deployed in the wellbore and seated on the lateral orientation device. In one or more embodiments, to the extent the tool 276 is a whipstock the whipstock is seated so that a guide surface or contoured surface 282 of the whipstock faces in the direction of the new secondary wellbore 12*b*, 12*c* to be drilled. A follower 281 or similar device on the whipstock may move along an orientation mechanism, such as orientation mechanism 250, of the lateral orientation device 130 in order axially and radially position the whipstock in the wellbore.

In step 410, once the whipstock has been deployed, the new secondary wellbore 12*b*, 12*c* can be constructed utilizing the whipstock. In one or more embodiments, where the primary wellbore 12 is cased, the whipstock may guide a cutting tool 292 (FIG. 8), which may include a casing mill, in order to mill a casing window 290 in the primary wellbore casing 200. After a casing window 290 has been cut, then the new secondary wellbore may be drilled in the formation 14 adjacent the casing window 290. The whipstock may guide a drill bit 294 and drill string of the cutting tool 292 through the casing window 290 into contact with the formation 14. In one or more embodiments, the whipstock may be used to guide casing, e.g., secondary wellbore casing 206, into the new secondary wellbore 12*b*, 12*c*, which casing may be cemented in place. In one or more embodiments, the whipstock may be used to guide subsurface equipment 56 (FIGS. 1 and 2) such as production equipment into the new secondary wellbore 12*b*, 12*c*. Thereafter, the whipstock may be removed to permit continued operations in the primary wellbore 12.

It will be appreciated that in certain wellbore arrangements, multiple strings of casing and/or tubing strings may surround the deployed lateral orientation device. In such case, in order to create the new secondary wellbore, the whipstock may be utilized to mill windows through multiple strings of casing and/or tubing strings before proceeding with formation drilling. Thus, in one or more embodiments, the whipstock may be utilized to cut through each of a tubing string, and/or production liner and/or production casing and/or intermediate casing, and/or surface casing and/or any other pipe at a particular location selected for a new secondary wellbore. In one or more embodiments, where an inner tubing deployed within a production liner can be withdrawn from the wellbore, such tubing is withdrawn and then the production liner is severed as described herein for receipt of the lateral orientation device 130.

It will further be appreciated that multiple new secondary wellbores 12*b*, 12*c* may be drilled from a primary wellbore 12. In such case, multiple lateral orientation devices 130*a*, 130*b* (FIG. 10) may be deployed in a spaced apart orientation along a primary wellbore 12, wherein the lowest new secondary wellbore 12*b* is drilled first, as described above. Thereafter, the procedure may be repeated above the lowest new secondary wellbore 12*b*, installing another lateral orientation device 130*b* and drilling yet another new secondary wellbore 12*c* and thereafter, repeating the process at increasingly shallower axial distances along a primary wellbore 12.

More broadly, to the extent some other operation other than drilling a new secondary wellbore 12*b*, 12*c* is to be performed, the steps relating to the whipstock may be eliminated or modified to suit the purposes of the operation. Thus, in one or more embodiments, a tubular string 210 may be severed as described herein and some other type of sleeve or tool is mounted on the exposed upper end of the tubular string lower portion 210*b*, after which, the sleeve or tool is utilized for the desired operation.

Moreover, while the foregoing has been generally described in terms of a primary wellbore 12 and one or more secondary wellbores 12*a*, 12*b*, 12*c* extending from a primary wellbore 12, it will be appreciated that the lateral orientation device 130 and methods described herein may also be utilized in secondary wellbores in order to drill twig wellbores therefrom. In such case, a secondary wellbore is generally referenced as the "first" wellbore and the proposed deviated wellbore to be drilled utilizing the lateral orientation device is generally referenced as the "second" wellbore.

Prior to, or subsequent to drilling the new secondary wellbore 12*b*, 12*c*, in one or more embodiments, a portion of the wellbore below the lateral orientation device 130 may be subjected to high pressure pumping operations. In one or more embodiments, these high pressure pumping operations may be hydraulic fracturing or re-fracturing. In order to conduct these high pressure pumping operations, at step 412, a work string 300 is deployed in the primary wellbore 12. The work string 300 may be selected to have a higher pressure rating than the primary wellbore casing 200. The work string 300 is deployed so that a distal end 302 of the work string 300 seats on the lateral orientation device 130 or otherwise within the primary wellbore casing 200. The work string 300 may be mechanically engaged to the lateral orientation device 130. A packer 308 may be deployed to seal the annulus between the work string 300 and the primary wellbore casing 200.

Once the work string 300 has been stabbed into the lateral orientation device 130 or otherwise affixed relative thereto, at step 414, in various pumping operations, the work string 300 may be used to deliver fluids to the wellbore, e.g., secondary wellbore 12*a*, below the lateral orientation device 130. These pumping operations may be high pressure pumping operations, such as fracturing or re-fracturing operations, and may be carried out in the primary wellbore 12 or a lower secondary wellbore 12*a*, after which, flow-back is established. It will be appreciated that this procedure may occur while maintaining the new secondary wellbore 12*b*, 12*c* in isolation from the lower primary or lower secondary wellbore 12*a*.

Thus, a lateral orientation device has been described. Embodiments of the lateral orientation device may generally include a tubular body having a first end, a second end, with a bore extending between the ends, the bore defining an inner tubular body surface and an outer tubular body surface, wherein the first end includes an orientation profile; a lower shoulder provided along the one of the tubular body surfaces; and a first sealing device disposed along the surface on which the shoulder is provided, the first sealing device disposed between the lower shoulder and the second end. Other embodiments of a lateral orientation device may generally include a tubular body having a first end, a second end, with a bore extending between the ends, the bore defining an inner tubular body surface and an outer tubular body surface, wherein the first end includes an orientation profile; a lower shoulder provided along one of the tubular body surfaces; and a first sealing device disposed along the surface on which the shoulder is provided, the first sealing device disposed on the surface between the lower shoulder and the second end. Other embodiments of a lateral orientation device may generally include a tubular body having a first end, a second end, with a bore extending between the ends, the bore defining an inner tubular body surface and an outer tubular body surface, wherein the first end includes an orientation profile; a shoulder provided along the inner tubular body surface; a first sealing device disposed along the inner surface between the lower shoulder and the second end; a second sealing device disposed along the outer tubular body surface; a first anchoring mechanism disposed along the inner tubular body surface between the lower shoulder and the second end; an second anchoring mechanism disposed along the outer tubular body surface. Likewise, a wellbore system has been described. The wellbore system may generally include a tubing string having a proximal cut end, a distal end and an outer string surface; a lateral orientation device engaging the proximal cut end of the tubing string, the lateral orientation device comprising a tubular body having a first end, a second end, with a bore extending between the ends, the bore defining an inner tubular body surface and an outer tubular body surface, wherein the first end includes an orientation profile; a lower shoulder provided along the inner tubular body surface and abutting the proximal cut end of the tubing string; and a first sealing device disposed along the inner surface between the lower shoulder and the second end and sealingly engaging the outer string surface. In other embodiments, the wellbore system may generally include a first elongated wellbore having a proximal end and a distal end; a tubing string deployed in the primary wellbore, the tubing string having a proximal end between the two ends of the wellbore, a distal end and an outer string surface; a lateral orientation device deployed in the primary wellbore and engaging the proximal end of the tubing string, the lateral orientation device comprising a tubular body having a first end, a second end, with a bore extending between the ends, the bore defining an inner tubular body surface and an outer tubular body surface, wherein the first end includes an orientation profile; a lower shoulder provided along the inner tubular body surface and abutting the proximal end of the tubing string; and a first sealing device disposed along the inner surface between the lower shoulder and the second end and sealingly engaging the outer string surface. A wellbore system has also been described and may generally include a primary wellbore; a tubing string deployed in a distal portion of the primary wellbore, the tubing string having a proximal end, a distal end and an outer string surface, the proximal end of the tubing string positioned within the primary wellbore at a location spaced apart from the proximal end of the primary wellbore; a lateral orientation device deployed in the primary wellbore and engaging the proximal end of the tubing string, the lateral orientation device comprising a tubular body having a first end, a second end, with a bore extending between the ends, the bore defining an inner tubular body surface and an outer tubular body surface, wherein the first end includes an orientation profile; a lower shoulder provided along the inner tubular body surface and abutting the proximal end of the tubing string; and a first sealing device disposed along the inner surface between the lower shoulder and the second end and sealingly engaging the outer surface of the proximal end of the tubing string. Likewise, a wellbore system deployed within a primary wellbore extending from a surface into a formation may generally include a casing string having a proximal cut end, a distal end and an outer string surface; a lateral orientation device engaging the proximal end of the casing string, the lateral orientation device comprising a tubular body having a first end, a second end, with a bore extending between the ends, the bore defining an inner tubular body surface and an outer tubular body surface, wherein the first end includes an orientation profile; a lower shoulder provided along the inner tubular body surface and abutting the proximal end of the casing string; and a first sealing device disposed along the inner surface between the lower shoulder and the second end and sealingly engaging the outer string surface.

For any of the foregoing embodiments, the completion assembly may include any one of the following elements, alone or in combination with each other:

- The lower shoulder is provided along the inner tubular body surface.
- The first sealing device is provided along the inner tubular body surface.
- A second sealing device disposed along the outer tubular body surface opposite the tubular body surface on which the shoulder is provided.
- A first anchoring mechanism disposed along the inner tubular body surface between the lower shoulder and the second end.
- The first anchoring mechanism is a slip.
- The first anchoring mechanism is between the lower shoulder and first sealing device.
- The first sealing device comprises an elastomeric element.
- The primary wellbore is a main wellbore and the secondary wellbore is a lateral wellbore.
- The primary wellbore is a lateral wellbore and the secondary wellbore is a twig wellbore.
- The first sealing device comprises at least two elastomeric elements.
- The second sealing device is a packer.
- The second sealing device comprises an elastomeric element.
- An anchoring mechanism disposed along the tubular body surface opposite the tubular body surface on which the shoulder is provided.
- The tubing string is substantially fixed within the wellbore in which the tubing string is deployed.

The tubing string is selected from a group consisting of tubing, liner, casing and pipe.

A second sealing device disposed along the tubular body surface between the anchoring mechanism and the second end of the tubular body.

The distal end of a work string abuts a shoulder formed along one of the surfaces of the lateral orientation device.

The anchoring mechanism comprises a slip.

The anchoring mechanism comprises at least two slips spaced apart from one another about the outer tubular body surface The anchoring mechanism comprises a packer.

The orientation profile is a contoured surface.

A sleeve comprises a lateral orientation device.

A lateral orientation device comprises a tubular body.

The orientation profile is linear ramp

The orientation profile is curvilinear ramp.

An edge is formed at the first end of the tubular body and the edge has a radial elevation change across the width of the tubular body.

An upper shoulder is formed along one of the tubular body surfaces.

The lower shoulder is formed along one tubular body surface and the upper shoulder is formed along the other tubular body surface.

An upper shoulder provided along the one of the tubular body surfaces.

A first engagement mechanism disposed along the surface on which the lower shoulder is provided, the first engagement mechanism between the lower shoulder and the first tubular body end.

The first engagement mechanism is a latch coupling.

The first engagement mechanism is a nipple.

The first engagement mechanism is a profile formed along the inner surface.

The first engagement mechanism comprises a threaded surface.

A second engagement mechanism disposed along tubular body surface on which the lower shoulder is provided, the second engagement mechanism between the lower shoulder and the first tubular body end.

A third engagement mechanism disposed along the tubular body surface on which the lower shoulder is provided, the third engagement mechanism between the lower shoulder and the first tubular body end.

A whipstock having a first end and a second end, the first end having a contoured edge, the second end seated on the lateral orientation device.

The whipstock further comprises an orientation device at the second end of the whipstock, the orientation device engaging the orientation profile of the lateral orientation device.

The proximal end of the tubing string is characterized by a tubing string edge and the tubular body is seated on the proximal end so that the edge abuts the shoulder and the first sealing device seals against the outer string surface.

The lateral orientation device further comprises an inner anchoring mechanism disposed along the inner tubular body surface between the shoulder and the first sealing device, the inner anchoring mechanism gripping the outer string surface.

A primary wellbore casing having an inner surface, the primary wellbore casing disposed about the lateral orientation device and tubing string, the lateral orientation device further comprising a second sealing device disposed on the outer surface of the tubular body and sealingly engaging the inner surface of the primary wellbore casing.

The lateral orientation device further comprises an outer anchoring mechanism disposed on the outer surface of the tubular body and gripping the inner surface of the primary wellbore casing.

The work string further comprises a seal disposed along the distal end that sealingly engages with a smooth surface between the shoulder and first tubular body end of the lateral orientation device.

A work string having a proximal end and a distal end, the distal end of the work string seated in the lateral orientation device.

The distal end of the work string abuts a shoulder formed along the inner surface of the lateral orientation device.

The primary wellbore is a main wellbore and the new secondary wellbore is a lateral wellbore extending from the main wellbore.

The primary wellbore is a lateral wellbore and the new secondary wellbore is a twig wellbore extending from the lateral wellbore.

The tubing string is selected from the group consisting of tubing, pipe, production liner, and production casing.

The lateral orientation device further comprises a first engagement mechanism disposed along the inner surface between the shoulder and first tubular body end and engaging the distal end of the work string.

A second sealing device disposed along the outer tubular body surface above the outer anchoring mechanism.

The first engagement mechanism is a latch mechanism.

The lateral orientation device further comprises a seal disposed along the inner tubular body surface between the shoulder and first tubular body end and sealingly engaged with the distal end of the work string.

A packer carried by the distal end of the work string and sealing between the work string and the primary wellbore casing.

The first and second anchoring mechanisms are slips and the second sealing device is a packer.

A first engagement mechanism disposed along the inner surface between the shoulder and the first tubular body end.

A method for drilling a new secondary wellbore from a primary wellbore has been described. The method may generally include exposing an end of a tubing string extending within the primary wellbore below a desired kick-off location for the new deviated wellbore; mounting a tubular body onto the end of the exposed tubing string; engaging the tubular body with a whipstock; utilizing the whipstock in drilling the new wellbore. Likewise, a method for drilling a new secondary wellbore from a primary wellbore has been described. The method may generally include exposing an end of a tubing string extending within the primary wellbore below a desired kick-off location for the new secondary wellbore; mounting a tubular body onto the end of the exposed tubing string; engaging the tubular body with a whipstock; utilizing the whipstock in drilling the new secondary wellbore. In other embodiments, the method may generally include exposing an end of a production casing extending within the primary wellbore below a desired kick-off location for the new deviated wellbore; and mounting a tubular body onto the end of the production casing. In other embodiments, the method may generally include severing a production casing extending within the primary wellbore below a desired kick-off location for the new deviated wellbore; and anchoring a lateral orientation device in the primary wellbore at a location between the severed production casing and the desired kickoff point. Likewise, a method for performing an operation in a wellbore has been described. The method may generally include severing a tubing string extending within a primary wellbore to expose a tubing string end on a downstream portion of the tubing string; withdrawing from the wellbore an unstring portion of the tubing string; mounting a sleeve onto the end of the exposed tubing string; and utilizing the sleeve to perform an operation in the wellbore. In other embodiments, the method may generally include severing a tubing string extending within a primary wellbore to expose a tubing string end on a downstream portion of the tubing string; withdrawing from the wellbore an unstring portion of the tubing string; mounting a sleeve onto the end of the exposed tubing string; engaging a tool with the sleeve; and utilizing the tool to perform an operation in the wellbore. For the foregoing embodiments, the method may include any one of the following steps, alone or in combination with each other:

- Mounting comprises sealing the annulus between the tubular body and the tubing string.
- Mounting comprises anchoring the tubular body to the tubing string.
- Anchoring comprises activating slips to engage the tubing string.
- The sleeve comprises a lateral orientation device.
- The lateral orientation device comprises a tubular body.
- Exposing comprises cutting the tubing string and withdrawing from the primary wellbore the tubing string upstream of the cut.
- Mounting comprises positioning a portion of the tubular body over the exposed tubing string until the tubing string abuts a shoulder of the tubular body.
- Drilling a primary wellbore; at least partially casing the primary wellbore; deploying production equipment in the primary wellbore; and producing hydrocarbons from the primary wellbore.
- Mounting comprises rotating the tubular body to a desired orientation within the primary wellbore.
- Anchoring the tubular body to the primary wellbore casing.
- Anchoring the tubular body to the primary wellbore casing at a desired depth.
- Anchoring the tubular body to the primary wellbore casing at a desired orientation.
- Sealing the annulus between the tubular body and the primary wellbore casing.
- Sealing comprises activating a packer to drive an elastomeric element into contact with the primary wellbore casing.
- Anchoring comprises activating slips to engage the primary wellbore casing.
- Transporting the tubular body into the primary wellbore on a running tool and once the tubular body is mounted to the production casing, releasing the tubular body from the running tool and withdrawing the running tool from the primary wellbore.
- Engaging comprises orienting a guide surface of the whipstock to face in the direction of a desired new wellbore.
- Engaging comprises seating an end of the whipstock on the tubular body.
- Seating comprises abutting an upper shoulder of the tubular body with an end of the whipstock.
- Seating comprises coupling an end of the whipstock to the tubular body to fix the whipstock to the tubular body.
- Seating comprises moving a follower mechanism of the whipstock along an upper contoured end of the tubular body to radially orient the whipstock.
- Utilizing the whipstock to direct a cutting device into contact with the casing of the primary wellbore; cutting a window in the casing of the primary wellbore, and thereafter drilling a new wellbore in the formation extending from the primary wellbore casing window.
- Cutting a window comprises milling a window in the primary wellbore casing.
- Setting a plug in a tubing string below the exposed end.
- Setting a plug in the tubular body.
- Engaging a distal end of a work string with the tubular body.
- Seating a tool on the tubular body.
- Utilizing a seated tool to drill a new secondary wellbore.
- Selecting a work string with a pressure rating higher than the pressure rating of the primary wellbore casing.
- Engaging comprises establishing a seal between the work string and the tubular body.
- Engaging comprises coupling an end of the work string to the tubular body.
- Establishing a seal between the work string and the primary wellbore casing.
- Establishing a seal comprises activating a packer carried on the work string.
- Passing a work string through the tubular body and establishing a seal between the work string and a tubing string downhole of the tubular body.
- Utilizing the work string to deliver a pressurized fluid to the tubular string.
- Utilizing the work string to deliver a pressurized fluid to the tubular string comprises conducting a wellbore servicing operation utilizing the pressurized fluid.
- A servicing operation is selected from the group consisting of wellbore stimulation, wellbore fracturing, and wellbore perforation.
- The primary wellbore is a main wellbore and the new secondary wellbore is a lateral wellbore extending from the main wellbore.
- The primary wellbore is a lateral wellbore and the new secondary wellbore is a twig wellbore extending from the lateral wellbore.
- Engaging the tubular body with a whipstock.
- Engaging comprises seating an end of the whipstock on the tubular body.
- Seating comprises abutting an upper shoulder of the tubular body with an end of the whipstock
- Seating comprises coupling an end of the whipstock to the tubular body to fix the whipstock to the tubular body.
- Seating comprises moving a follower mechanism of the whipstock along an upper contoured end of the tubular body to radially orient the whipstock.
- Anchoring the tubular body to the primary wellbore casing at a desired orientation.
- Utilizing a running tool to orient the tubular body to a desired angular orientation.
- Utilizing the whipstock to direct a cutting device into contact with the casing of the primary wellbore; cutting a window in the casing of the primary wellbore, and thereafter drilling a new wellbore in the formation adjacent the primary wellbore casing window.
- Cutting a window comprises milling a window in the primary wellbore casing.
- Seating comprises coupling an end of the whipstock to the tubular body to fix the whipstock rotationally to the tubular body.

Seating comprises coupling an end of the whipstock to the tubular body to fix the whipstock axially and rotationally to the tubular body.

Mounting comprises sealing the annulus between the sleeve and the tubing string.

Mounting comprises anchoring the sleeve to the tubing string.

The sleeve comprises a lateral orientation device.

The lateral orientation device comprises a sleeve.

Mounting comprises positioning a portion of the sleeve over the exposed tubing string until the tubing string abuts a shoulder of the sleeve.

Mounting comprises rotating the sleeve to a desired orientation within the primary wellbore.

Anchoring the sleeve to the primary wellbore casing.

Anchoring the sleeve to the primary wellbore casing at a desired depth.

Anchoring the sleeve to the primary wellbore casing at a desired orientation.

Sealing the annulus between the sleeve and the primary wellbore casing.

Transporting the sleeve into the primary wellbore on a running tool and once the sleeve is mounted to the production casing, releasing the sleeve from the running tool and withdrawing the running tool from the primary wellbore.

Engaging comprises seating an end of the whipstock on the sleeve.

Seating comprises abutting an upper shoulder of the sleeve with an end of the whipstock.

Seating comprises coupling an end of the whipstock to the sleeve to fix the whipstock to the sleeve.

Seating comprises moving a follower mechanism of the whipstock along an upper contoured end of the sleeve to radially orient the whipstock.

Setting a plug in the sleeve.

Engaging a distal end of a work string with the sleeve.

Seating a tool on the sleeve.

Engaging comprises establishing a seal between the work string and the sleeve.

Engaging comprises coupling an end of the work string to the sleeve.

Passing a work string through the sleeve and establishing a seal between the work string and a tubing string downhole of the sleeve.

Engaging the sleeve with a tool.

Engaging comprises seating an end of the tool on the sleeve.

Seating comprises abutting an upper shoulder of the sleeve with an end of the tool.

Seating comprises coupling an end of the tool to the sleeve to fix the tool to the sleeve.

Seating comprises moving a follower mechanism of the tool along an upper contoured end of the sleeve to radially orient the tool.

Anchoring the sleeve to the primary wellbore casing at a desired orientation.

Utilizing a running tool to orient the sleeve to a desired angular orientation.

Seating comprises coupling an end of the tool to the sleeve to fix the tool rotationally to the sleeve.

The tool is a whipstock.

Seating comprises coupling an end of the whipstock to the sleeve to fix the whipstock axially and rotationally to the sleeve.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

The invention claimed is:

1. A lateral orientation device comprising:

a tubular body having a first end, a second end, with a bore extending between the ends, the bore defining an inner tubular body surface and an outer tubular body surface, wherein the first end includes an orientation profile;

a lower shoulder protruding radially from one of the inner and outer tubular body surfaces and axially spaced from the second end; and a first sealing device disposed along the surface from which the lower shoulder protrudes, the first sealing device disposed axially between the lower shoulder and the second end such that the first sealing device is operable form a seal with an axially overlapping portion of a tubing string spaced from walls of a wellbore when the tubular body is installed within or around an end of the tubing string such that the lower shoulder abuts the end of the tubing string.

2. The device of claim 1, further comprising a second sealing device disposed along one the inner and outer tubular body surfaces, wherein the surface on which the second sealing device is provided is opposite the tubular body surface on which the shoulder is provided.

3. The device of claim 1, further comprising a first anchoring mechanism disposed along the tubular body surface on which the lower shoulder is provided, the first anchoring mechanism disposed between the lower shoulder and the second end.

4. The device of claim 1, wherein an edge is formed at the first end of the tubular body and the edge has a radial elevation change across the tubular body.

5. The device of claim 1, further comprising an upper shoulder provided along one of the inner and outer tubular body surfaces.

6. The device of claim 1, further comprising a first engagement mechanism disposed along the surface on which the lower shoulder is provided, the first engagement mechanism between the lower shoulder and the first tubular body end.

7. The device of claim 1, further comprising a tubular having an upper end engaged with the lower shoulder and wherein the first sealing device seals against an outer surface of the tubular.

8. A system for drilling a new secondary wellbore extending from a primary wellbore, the system comprising:

an elongated primary wellbore having a proximal end and a distal end;

a tubular string portion, the tubular string portion having a proximal end positioned between the two ends of the primary wellbore, a distal end and an outer string surface;

a lateral orientation device deployed in the primary wellbore and engaging the proximal end of the tubular string portion, the lateral orientation device comprising a tubular body having a first end, a second end, with a bore extending between the first and second ends, the bore defining an inner tubular body surface and an outer tubular body surface, wherein the first end includes an orientation profile;

a lower shoulder provided along the inner tubular body surface and abutting the proximal end of the tubular string portion; and a first sealing device disposed along the inner tubular body surface between the lower shoulder and the second end and sealingly engaging the outer string surface.

9. The system of claim 8, wherein the proximal end of the tubular string portion is characterized by a tubular string portion edge, and wherein the tubular body is seated on the proximal end so that the tubular string portion edge abuts the lower shoulder and the first sealing device seals against the outer string surface.

10. The system of claim 9, wherein the lateral orientation device further comprises an inner anchoring mechanism disposed along the inner tubular body surface between the lower shoulder and the first sealing device, the inner anchoring mechanism gripping the outer string surface.

11. The system of claim 10, further comprising a primary wellbore casing having an inner surface, the primary wellbore casing disposed about the lateral orientation device and tubular string portion, the lateral orientation device further comprising a second sealing device disposed on the outer tubular body surface and sealingly engaging the inner surface of the primary wellbore casing.

12. The system of claim 11, wherein the lateral orientation device further comprises an outer anchoring mechanism disposed on the outer tubular body surface and gripping the inner surface of the primary wellbore casing or wellbore wall.

13. The system of claim 8, further comprising a whipstock having a first end and a second end, the first end having a contoured edge, the second end seated in the lateral orientation device.

14. The system of claim 13, wherein the whipstock further comprises an orientation device at the second end of the whipstock, the orientation device engaging the orientation profile of the lateral orientation device.

15. The system of claim 8, further comprising a work string having a proximal end and a distal end, the distal end of the work string seated on the lateral orientation device.

16. A method for drilling a secondary wellbore from a primary wellbore, the method comprising:

exposing a proximal end of a tubular string portion extending within the primary wellbore below a desired kick-off location for the new secondary wellbore, wherein exposing comprises severing a tubular string extending within the primary wellbore and withdrawing an upper portion of the tubular string from the primary wellbore;

mounting a tubular body onto the proximal end of the tubular string portion;

engaging the tubular body with a whipstock;

utilizing the whipstock in drilling the secondary wellbore.

17. The method of claim 16, wherein mounting comprises sealing an annulus between the tubular body and the tubular string portion.

18. The method of claim 17, further comprising setting a plug in the tubular string portion below the proximal end.

19. The method of claim 17, further comprising engaging a distal end of a work string with the tubular body and delivering a pressurized fluid to the tubular string portion through the work string.

20. The method of claim 16, further comprising producing hydrocarbons from the primary wellbore through the tubular string prior to severing the tubular string.

* * * * *